US005324249A

United States Patent [19]

Konzal

[11] Patent Number: 5,324,249

[45] Date of Patent: Jun. 28, 1994

[54] CUP MAKING MACHINE

[75] Inventor: Daryl R. Konzal, Colgate, Wis.

[73] Assignee: Paper Machinery Corporation, Milwaukee, Wis.

[21] Appl. No.: 937,586

[22] Filed: Aug. 28, 1992

[51] Int. Cl.[5] ..... B31B 1/32

[52] U.S. Cl. ..... 493/109; 493/108; 493/158; 493/106

[58] Field of Search ..... 493/105, 106, 152, 154, 493/155, 156, 157, 107, 108, 109, 102, 159, 158

[56] References Cited

U.S. PATENT DOCUMENTS

| | | | |
|---|---|---|---|
| 1,819,318 | 8/1931 | Barbieri | 493/158 |
| 2,049,419 | 8/1936 | Barbieri | 493/107 |
| 2,942,530 | 6/1960 | Bodendoerfer . | |
| 3,134,307 | 5/1964 | Loeser . | |
| 3,364,825 | 1/1968 | Baumgartner . | |
| 3,724,093 | 4/1973 | Olila . | |
| 3,825,408 | 7/1974 | Farfaglia . | |
| 4,035,926 | 7/1977 | Farfaglia . | |
| 4,074,619 | 2/1978 | Feliks . | |
| 4,295,838 | 10/1981 | Richards | 493/105 |
| 4,317,323 | 3/1982 | Richards . | |
| 4,349,400 | 9/1982 | Gilden . | |
| 4,490,130 | 12/1984 | Konzal . | |
| 4,680,016 | 7/1987 | Lynch | 493/158 |
| 5,176,607 | 1/1993 | Hill | 493/154 |

*Primary Examiner*—Jack Lavinder
*Attorney, Agent, or Firm*—Foley & Lardner

[57] ABSTRACT

A machine for making cups of thermoplastic coated paper, the machine including a frame or housing having a turret rotatably mounted on the frame, a number of work stations mounted on the frame in an equally spaced relation around the turret, a number of mandrels corresponding to the number of work stations mounted on the turret and a curling die mounted on the turret in radial alignment with each of the mandrels. The turret being rotated intermittently to align the mandrels sequentially with the work stations, the work stations being movable radially inwardly into a working relation with each mandrel, the mandrels being moved radially inwardly simultaneously with the work stations to form a tucked curl on the top edge of the cup.

16 Claims, 29 Drawing Sheets

CUP MAKING MACHINE

FIELD OF THE INVENTION

The present invention relates to a machine for the manufacture of thermoplastic coated paper cups and more particularly to a single turret cup making machine having an improved system for heating and feeding the side wall blanks to the turret and curling the lip of the cup.

BACKGROUND OF THE INVENTION

Two piece thermoplastic coated paper cups of the type produced by previous machines are made up from a side wall blank and a circular bottom wall blank. Typically the machine at which the blanks are assembled includes a turret mounted on a vertical axis and having a number of mandrels projecting radially outwardly from the turret axis. The turret is intermittently stepped to rotate the mandrels to each of a number of work stations. In the operation of the machine, a flanged bottom wall blank is concentrically attached by suction to the end surface of each mandrel, a side wall blank is wrapped around the mandrel and the edges bonded together to form a seam. A flange on the bottom wall blank is then bonded to a flange on the end of the side wall blank to seal the bottom.

In U.S. Pat. No. 4,490,130, issued Dec. 25, 1984, to Daryl R. Konzal, et al., entitled, "Machine For Forming Seams Of Two-Piece Paper Cups," a machine is described for making two-piece flat bottom paper cups of thermoplastic coated papers, each including a side wall blank and a disc-like bottom wall blank. In this machine, the disc-like bottom wall blank is of circular cross section and temporarily held against a flat outwardly facing surface of the mandrel by a vacuum. The edges of the circular blank extend outwardly from the end of the mandrel and are folded to form a flange. A separate turret is provided for feeding the side wall blanks to the main turret, which requires heating of the bottom edge of one end of the blank at one station and heating the top of the edge at the other end of the blank at a second station prior to wrapping the blank around the mandrel. The side wall blank is then wrapped around the mandrel so that the heated edges overlap and are sealed. The bottom edge of the blank extends beyond the end of the mandrel and overlaps the flange of the bottom wall blank. Heaters are provided for heating the thermoplastic coating on the flange portions of the blanks to provide for their adhesion to one another when folded inwardly against the bottom of the mandrel. This application was concerned primarily with a system for separately heating the bottom edge of one end of the blank and the top edge of the other end of the blank with hot air prior to wrapping the blank around the mandrel.

SUMMARY OF THE PRESENT INVENTION

In accordance with the present invention a machine is provided for making two-piece flat bottom paper cups of thermoplastic coated paper which includes a side wall blank and a disc-like bottom wall blank wherein the flange at the bottom of the side wall blank is heated and folded into engagement with the disc-like bottom wall blank. The machine contemplates a number of mandrels mounted on a turret with a corresponding number of work stations located radially outwardly from the mandrels. Each mandrel has a circular cross section around which the side wall blank is wrapped with a bottom wall blank held by vacuum on the outwardly facing surface of the mandrel. The flange at the bottom of the side wall blank is heated and folded into engagement with the bottom wall blank. The lip at the top of the side wall blank is simultaneously curled by a curling die mounted on the turret at the inner end of each mandrel, the mandrel being mounted for radial movement inwardly to progressively curl the lip at successive work stations.

This invention also contemplates a unique delivery system for feeding side wall blanks to the turret which reduces the time requirement for feeding side wall blanks to the turret. In this regard, the delivery system generally includes a vacuum pick-up mechanism for transferring precut side wall blanks from a hopper or magazine to a plate wherein the bottom of one end of the blank and the top of the other end of the blank are heated, simultaneously. The blanks are then pushed onto the turret and folded around the mandrel with the edges lying in an overlapping relation on the top of the mandrel. The edges are then pressed into sealing engagement to form the cup. The side wall blank is advanced by a novel pusher system which allows for the transfer of a subsequent side wall blank onto the table as the preceding blank is pushed into alignment with the mandrel whereby the edges of the next side wall blank will be heated on the return motion of the pusher mechanism.

This type of reciprocating system is very compact and does not require a secondary turret to move the side wall blanks through their heaters and then into the wrapping station. Additionally, the ability of the push rods to drop below the surface of the vacuum plate promotes efficiency of operation by allowing a second blank to be heated while the push rods move through their return cycle.

In accordance with another aspect of this invention, a tucked curl is given to the open edge of the container while the container remains on one of the mandrels on the turret. The curl is initiated by forcing the container against a fixed ring located radially inwardly of the mandrel. The exposed edge of the curl is then completely tucked out of sight by a clam shell type ring which opens and then closes around the mandrel and container. This clam shell ring forces the exposed edge of the curl up and under the curl so that the edge is hidden. The ability to make a completely tucked curl while the container is still on the mandrel obviates the need for a space taking station where the container would be removed from the mandrel and formed on a series of rings external to the turret/mandrel assembly.

A further modification has been made which reduces the noise levels in the area of the machine due to the passage of air through the mandrel when the bottom blanks are seated on the end of the mandrel and when the finished cup is blown off of the mandrel. This reduction in noise is attributed to the replacement of the end of the mandrel with a sintered disc which allows for both a vacuum to be drawn through the sintered disc to hold the bottom blank in place and air under pressure is blown through the disc at the end of the mandrel to blow the cup off of the mandrel.

Other principal features and advantages of the invention will become apparent to those skilled in the art upon review of the following drawings, the detailed description and the appended claims.

Figure 1:
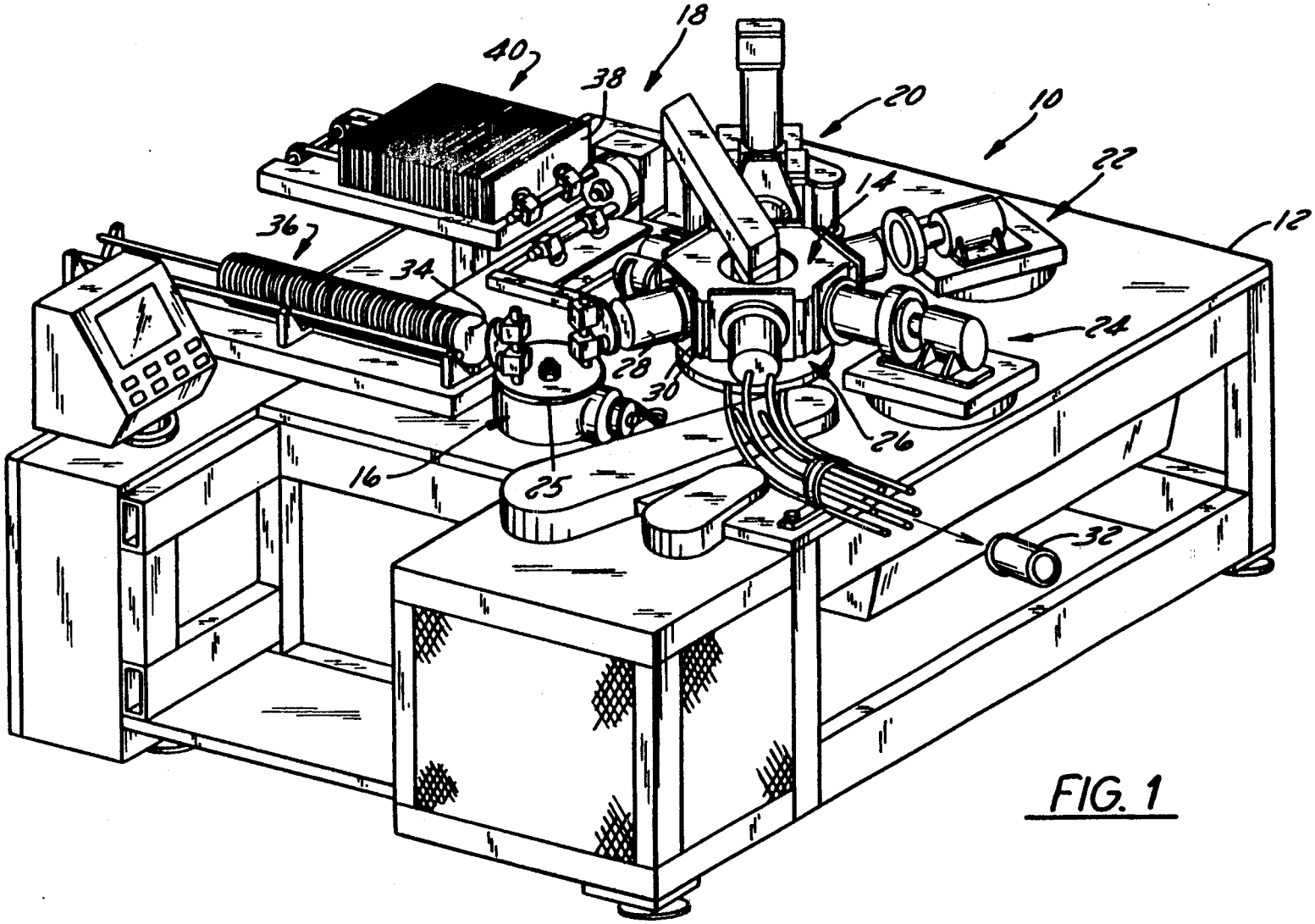
FIG. 1 is a schematic perspective view of the overall cup making machine.

Before explaining at least one embodiment of the invention in detail it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

DETAILED DESCRIPTION OF THE PREFERRED EMBODIMENTS

Figure 2:
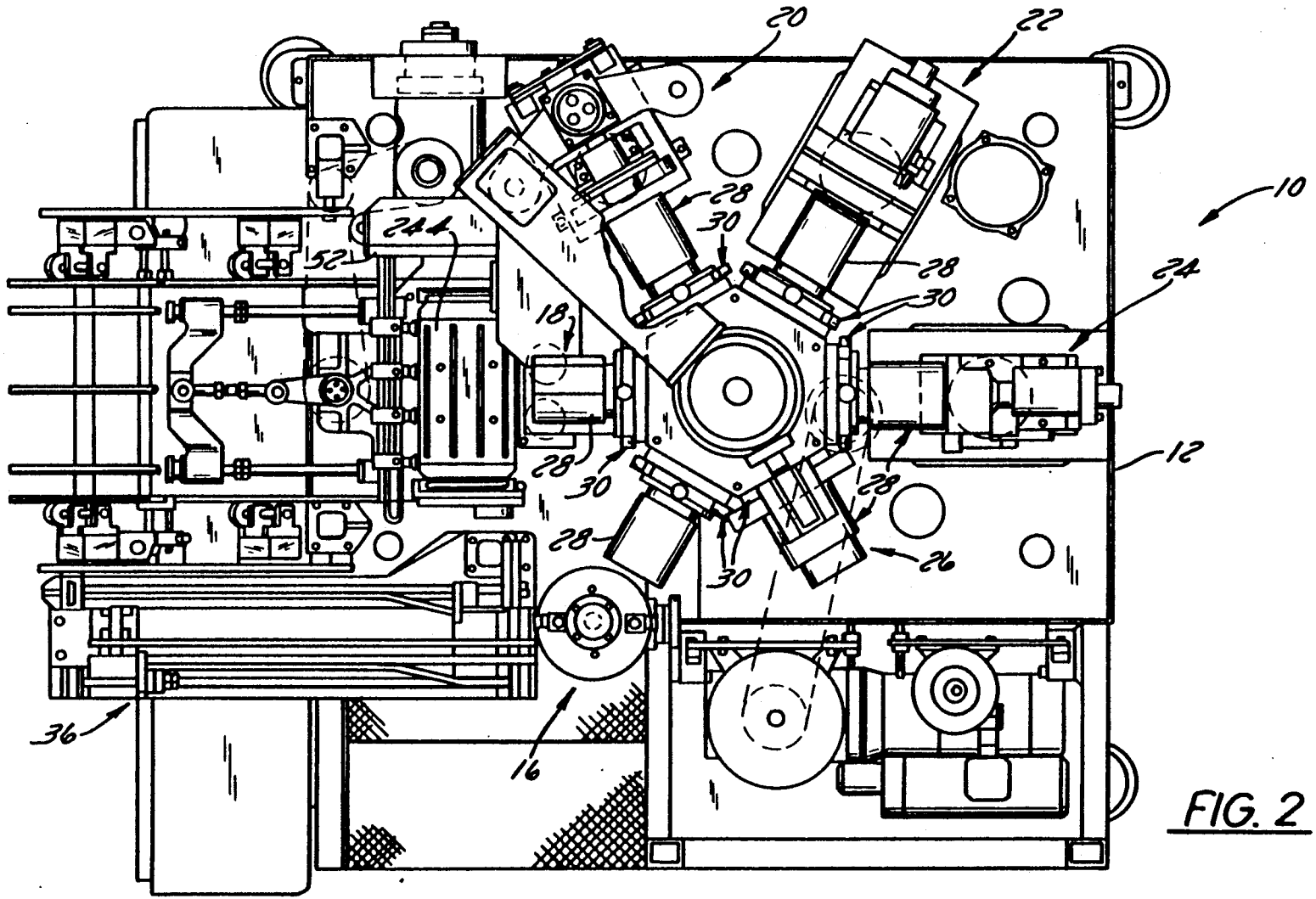
FIG. 2 is a top view of the cup making machine.
Figure 3:
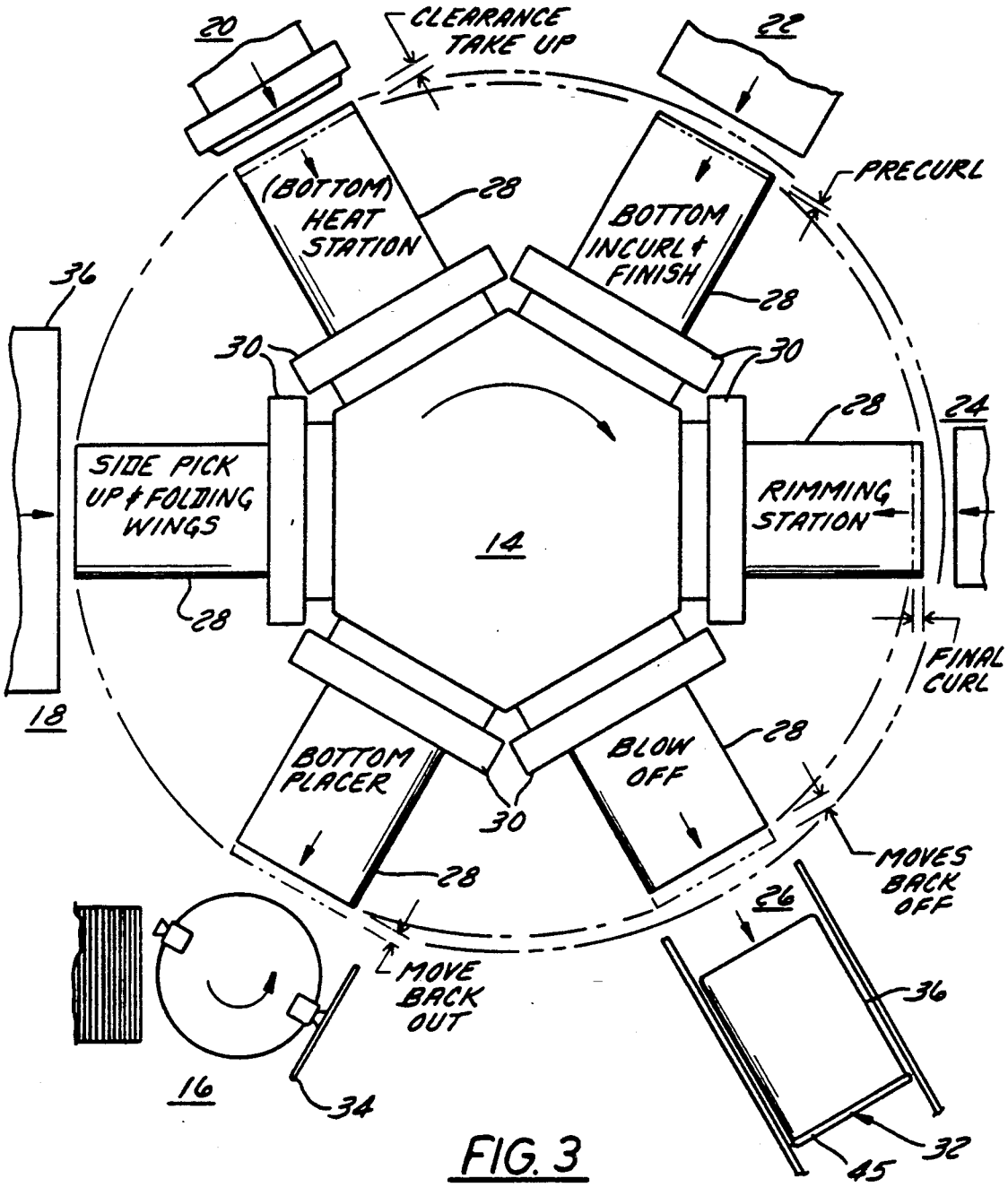
FIG. 3 is a schematic top view of the cup making machine showing the relation of the mandrels to the work stations.

The cup forming machine 10 according to the present invention as shown in FIGS. 1, 2 and 3 generally includes a base or frame 12 having a turret 14 mounted for rotary motion on the frame on a generally vertical axis. A number of work stations, 16, 18, 20, 22, 24 and 26, are mounted on the frame in an equally spaced relation around the perimeter of the turret 14. A corresponding number of mandrels 28 are mounted on the turret 14 extending radially outwardly into alignment with the work stations 16 through 26. A curling die assembly 30 is located radially inwardly of the inner end of each of the mandrels 28. As is generally understood in the art, the turret 14 is rotated in a step-by-step manner to sequentially align the mandrels 28 with the work stations to form a cup 32.

In this regard at the first work or "bottom placer" station 16 a bottom disc 34 is picked up from a magazine 36 by a vacuum pick-up assembly 25 and placed on the end of mandrel 28. The turret 14 is then indexed to the second or "side wall placer" station 18 wherein a side wall blank 38 is picked up from a magazine 40 by a vacuum pick-up assembly 27, pushed onto a folding wing assembly 352 under the mandrel 28 and folded around the mandrel 28. The mandrel is then stepped to the third or heat work station 20 wherein the bottom edge 42 of the side wall blank 38 is heated. The turret 14 is then stepped to move the mandrel to the fourth or bottom incurl and finish work station 22 wherein the bottom edge 42 of the blank 38 is folded inward and heat sealed to the bottom disc 34. The turret is then stepped to move the mandrel 28 to the fifth or "rimming" work station 24 wherein the cup is numbered. The turret is stepped to move the mandrel 28 to the sixth or "blow off" station 26 wherein the finished cup 32 is ejected from the mandrel.

Figure 4:
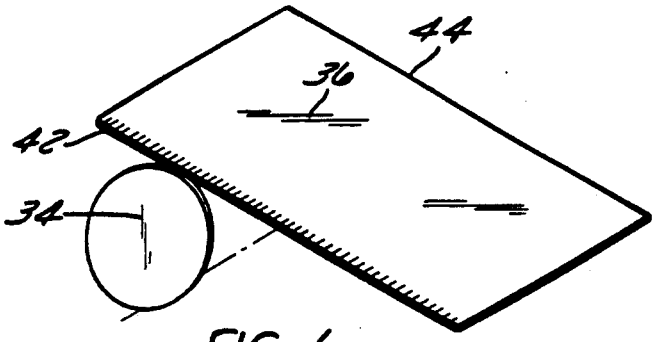
FIG. 4 is a perspective view of the bottom wall blank and side wall blank which form the cup.
Figure 5A:
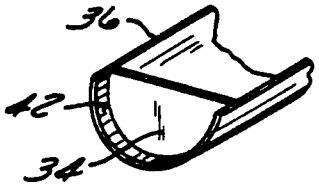
FIGS. 5 and 5A are perspective views of the bottom blank and side wall blank at the heat station.
Figure 5:
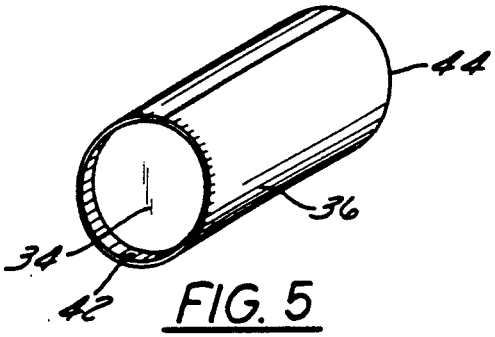
Figure 6:
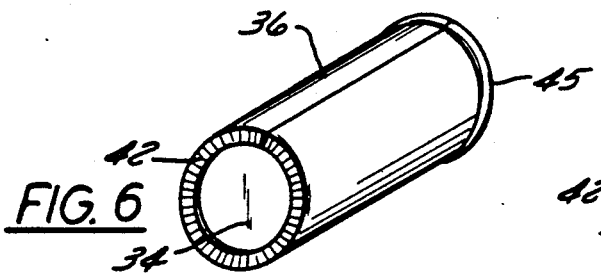
FIGS. 6 and 6A are perspective views of the blanks at the cup incurl and finish station.
Figure 6A:
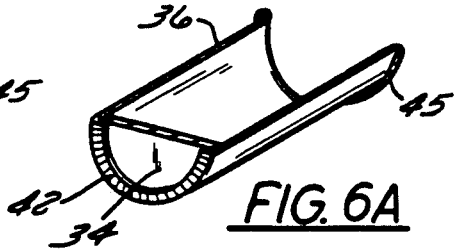
Figure 7:
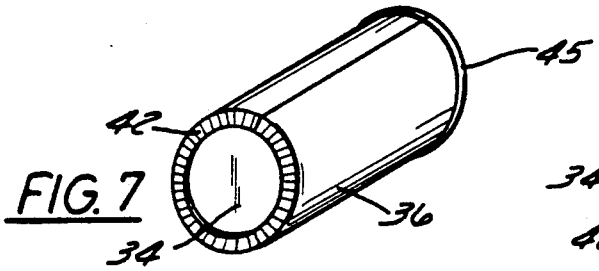
FIGS. 7 and 7A are perspective views of the blanks at the rimming station.
Figure 7A:
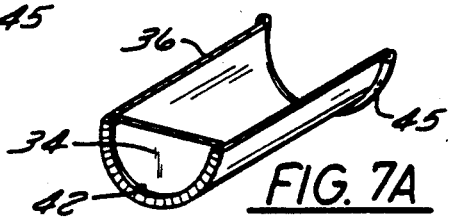

As above noted, the cup 32 is formed from a bottom disc 34 and a side wall blank 36. The bottom edge 42 of the side wall blank 36 as shown in FIG. 4 is serrated to allow the bottom edge 42 to be folded into engagement with the bottom disc 34. The blank 36 is wrapped around the disc 34 as shown in FIGS. 5 and 5A at the folding work station 18. The edge 42 which protrudes from the disc 34 is heated at the "heat" work station 20. The edge 42 is folded inward as shown in FIGS. 6 and 6A at the incurl work station 22 and heat sealed to the bottom disc 34. In accordance with one aspect of the present invention, a curled lip 45 is formed at the top edge 44 of the blank 36 in the curling die 30 at the third, fourth and fifth work stations at the same time as the bottom edge 42 is heated and sealed to the bottom disc 34.

MANDREL

Figures 8, 8A, 8B:
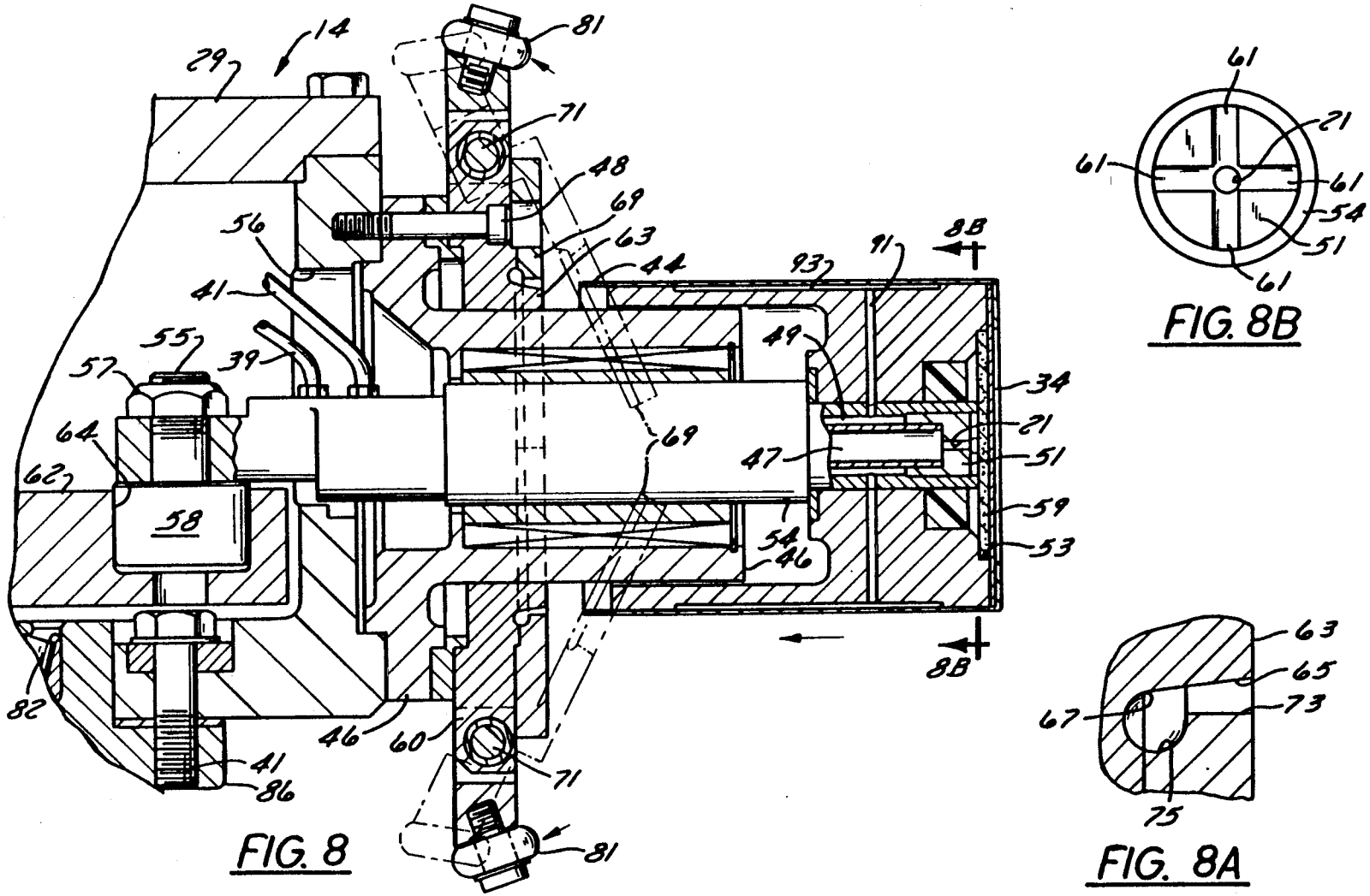
FIG. 8 is a cross-section view of one of the mandrels.
FIG. 8A is an enlarged view of the curl ring encircled on FIG. 8.
FIG. 8B is a view taken on line 8B—8B showing the air path at the end the shaft.
Figures 9, 10:
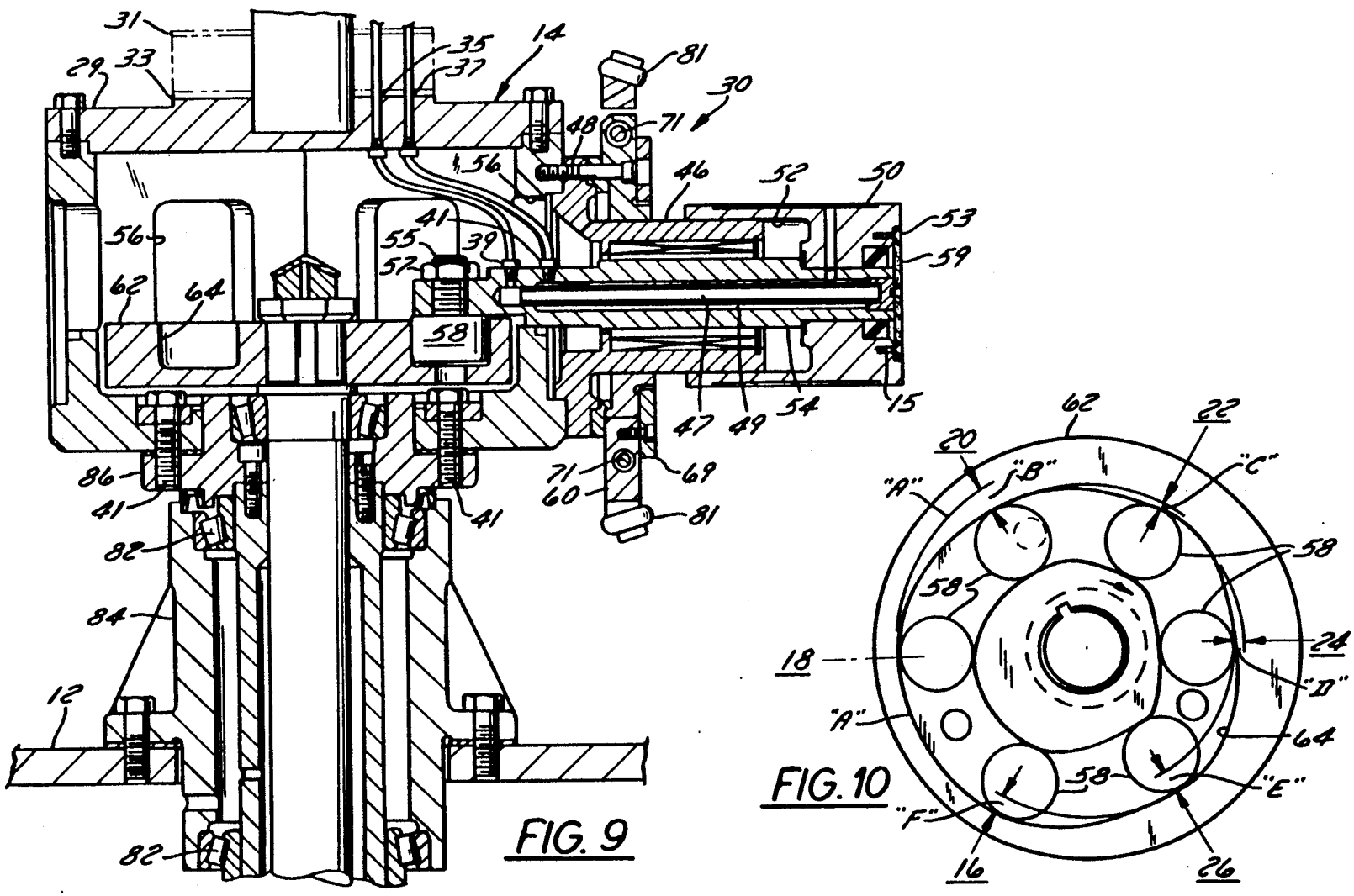
FIG. 9 is a cross-sectional view showing the cam plate and drive assembly for moving the mandrel radially inward and outward on the turret.
FIG. 10 is a plan view of the cam plate and the relative location of the cam followers in the groove of the cam plate.
Figure 23:
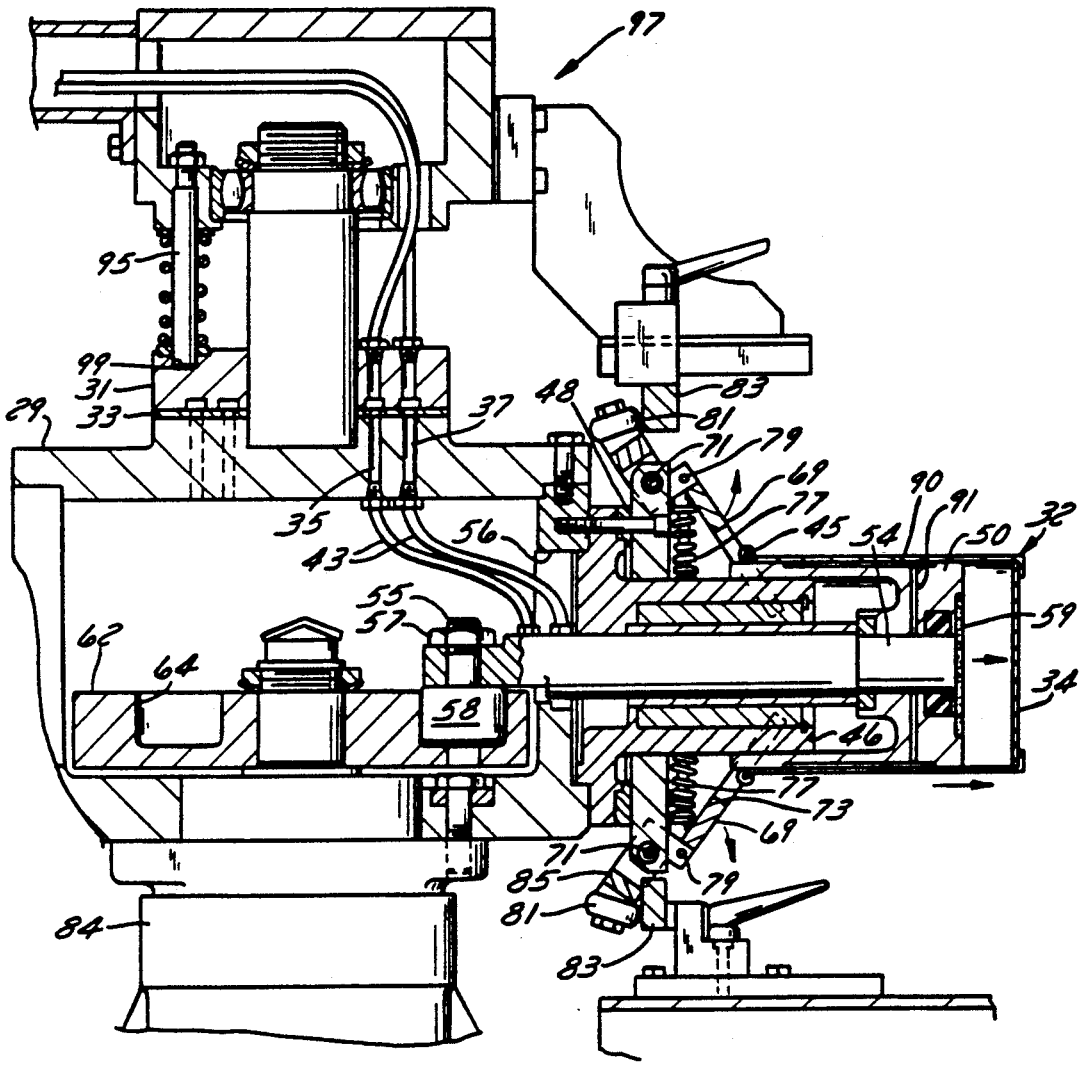
FIG. 23 is a side view partly in section of the mandrel at the blow off station.

Each mandrel 28, as shown in FIGS. 8, 9 and 23, generally includes a cylindrical housing 46 which is secured to the turret 14 by bolts 48. A cylindrical cap 50 having a cylindrical opening 52 is slidably mounted for reciprocal motion on the cylindrical housing 46. The cap 50 is connected to a hollow shaft 54 which extends radially inwardly through an opening 56 in the turret 14. A cam follower 58 is mounted on the end of the shaft 54 by a bolt 55 and nut 57. A sintered plate 59 is mounted in a recess 53 on the face of the mandrel cap 50 in close proximity to the end of shaft 54 and secured therein by screws 15. As more particularly described herein air is drawn through the sintered plate 59 to hold the bottom disc 34 on the mandrel and air is blown through the sintered plate to discharge the finished cup 32 from the mandrel 28.

CURLING DIE ASSEMBLY

The curling die assembly 30 as shown in FIGS. 8, 8A, 23 and 24 is mounted on the housing 46 to form the tucked curled lip 45 on the top edge 44 of the side wall blank 38. The curling die assembly 30 generally includes a plate 60 which is mounted on the cylindrical housing 46 of the mandrel 28 and is retained thereon by bolts 48. The plate 60 includes a die ring 63 having a beveled edge 65 which terminates at a forming curl 67 in plate 60, FIG. 8A. The die ring 63 has a diameter slightly smaller than the diameter of cap 50 at the outer edge as shown in FIG. 8A. The die tapers outwardly to a diameter substantially equal to the diameter of the cap 50 to direct the top edge 44 of blank 38 into the forming curl 67. A pair of U-shaped die plates 69 are mounted on a pivot plate 85 by bolts 91. The pivot plate 85 is pivotally mounted on pins 71 at the top and bottom of plate 60. Each die plate 69 includes a semi-circular opening 73 which has a diameter slightly greater than the diameter of cap 50. A forming curl 75 is provided around the inner edge of the opening 73 which forms a continuation of the forming curl 67 in plate 60. The top edge 44 of the side wall blank 38 is progressively moved into the gap between die ring 65 and the die plate 69 to curl the lip of the cup as more particularly described herein.

Figure 24:
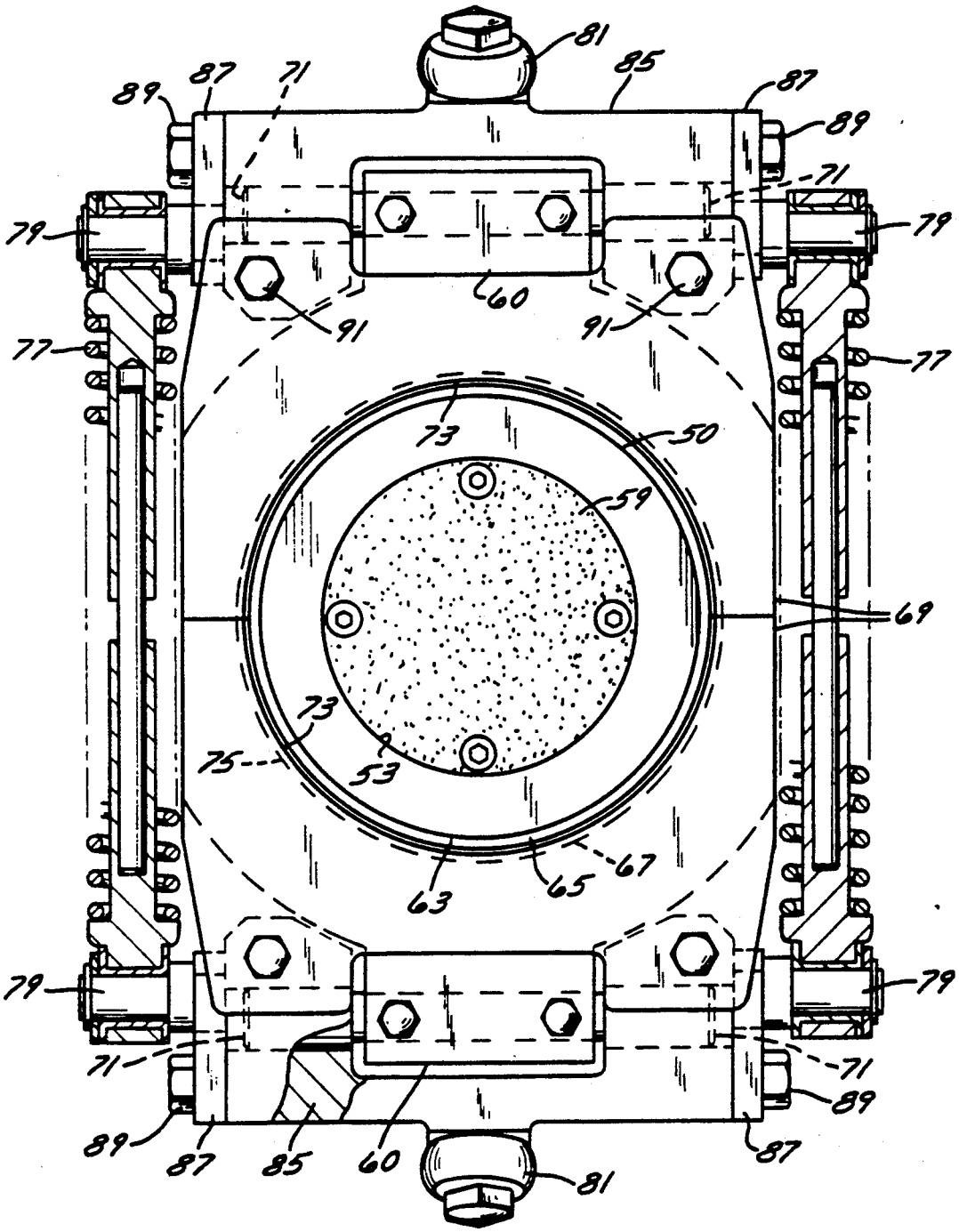
FIG. 24 is a front elevational view of the mandrel.

The die plates 69 are biased to the closed position by a pair of tension springs 77, FIG. 24, mounted on pins 79 on each end of side plates 87 which are mounted on the side of pivot plates 87 by bolts 89. The die plates 69 are pivoted to the open position by cam rollers 81 mounted on the ends of pivot plates 69. The cam rollers 81 engage fixed cams 83 mounted on the frame 12 at the blow off station 24 as shown in FIG. 23.

In accordance with another aspect of the present invention the noise level has been reduced by mounting the sintered plates 59 in the end of each mandrel 28 through which air is drawn or discharged as required. In this regard when the mandrel is located at the bottom placer station 16, air is drawn through the sintered plate 59 to create a vacuum to draw the bottom disc 34 to the end of the mandrel. When the mandrel is located at the blow off station 26, air is blown into the mandrel to discharge the finished cup from the machine. The noise level at the sintered plate 59 has been monitored and determined to be 10 to 15 decibels less than the noise level at the present machines.

TURRET DRIVE ASSEMBLY

In accordance with a further aspect of the present invention the mandrels 28 are progressively moved inwardly toward the curling die 30 when aligned with the third, fourth and fifth work stations 20, 22 and 24 to form the curled lip 45 around the top 44 of the cup 32. In this regard and referring to FIGS. 9 and 10 it should be noted that the cam plate 62 in the turret 14 includes a cam groove 64 that is aligned with the cam follower 58 which is attached to the inner end of shaft 54 in each mandrel 28. The cam plate 62 is advanced with the turret 14 each time the turret 14 is rotated to move the mandrels 28 to the next work station. The cam plate 62 is returned to its original position in synchronism with the movement of the work stations to progressively form the curled lip 45 on the top edge 44 of the blank 36.

The turret 14, mandrels 28 and stations 16, 18, 20, 22, 24, 26 are driven in synchronism by means of a drive assembly 66 which is mounted in frame 12. As shown in FIGS. 9 through 12, the drive assembly 66 generally includes a drive shaft 68 which is driven by a motor 70 through a worm gear 72. A mandrel turret cam 74 is mounted on the drive shaft 68 in a position to engage a stepping cam follower 76 provided on the end of the mandrel turret drive shaft assembly 78, FIGS. 10 and 12. The stepping cam follower 76 is mounted on the end of a turret shaft 80 which is supported for rotation on roller bearings 82 which are seated on bracket 84 on frame 12. The turret 14 is mounted on a bracket 86 secured to the upper end of the turret shaft 85 by bolts 41. The turret 14 is advanced one step or 60° in each revolution of the mandrel cam 74 as more fully described hereinafter.

Figure 11:
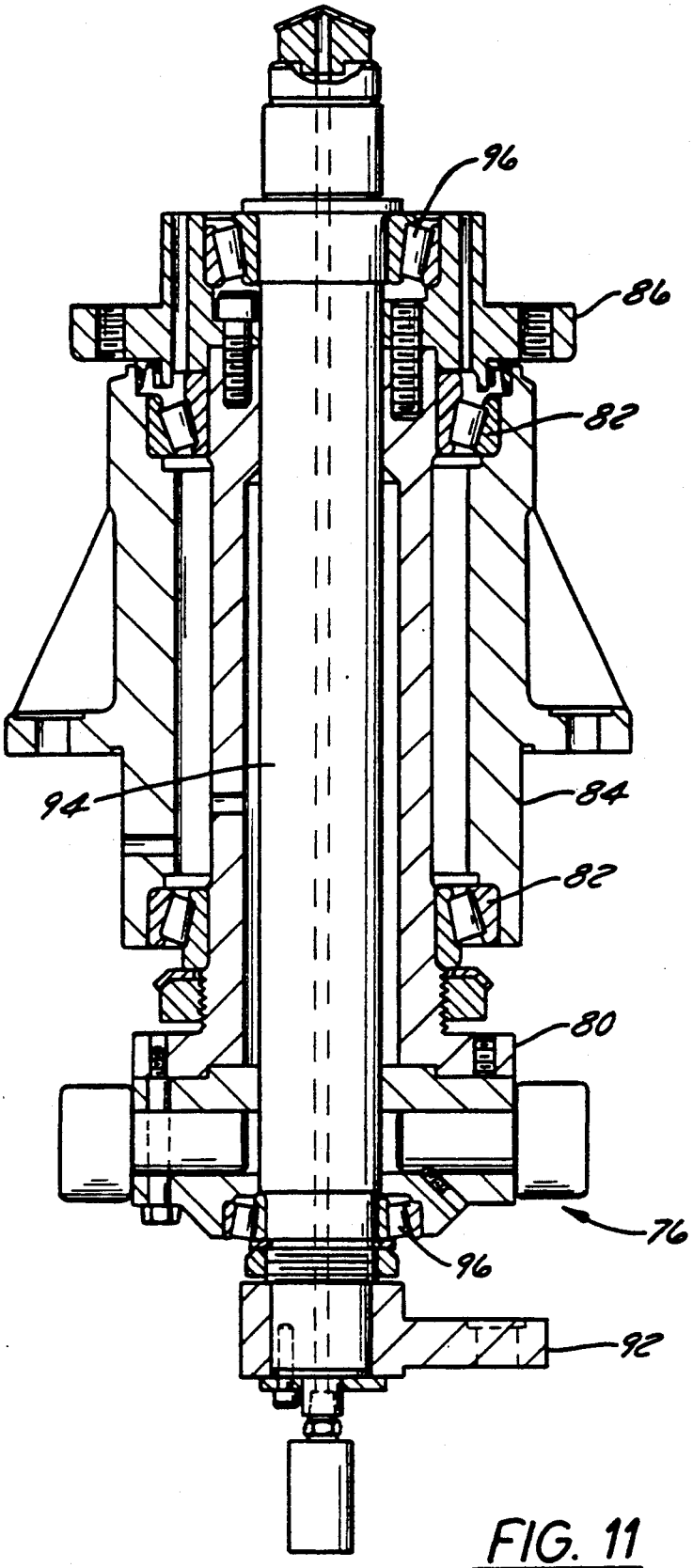
FIG. 11 is a schematic view of the cam plate drive assembly.
Figure 12:
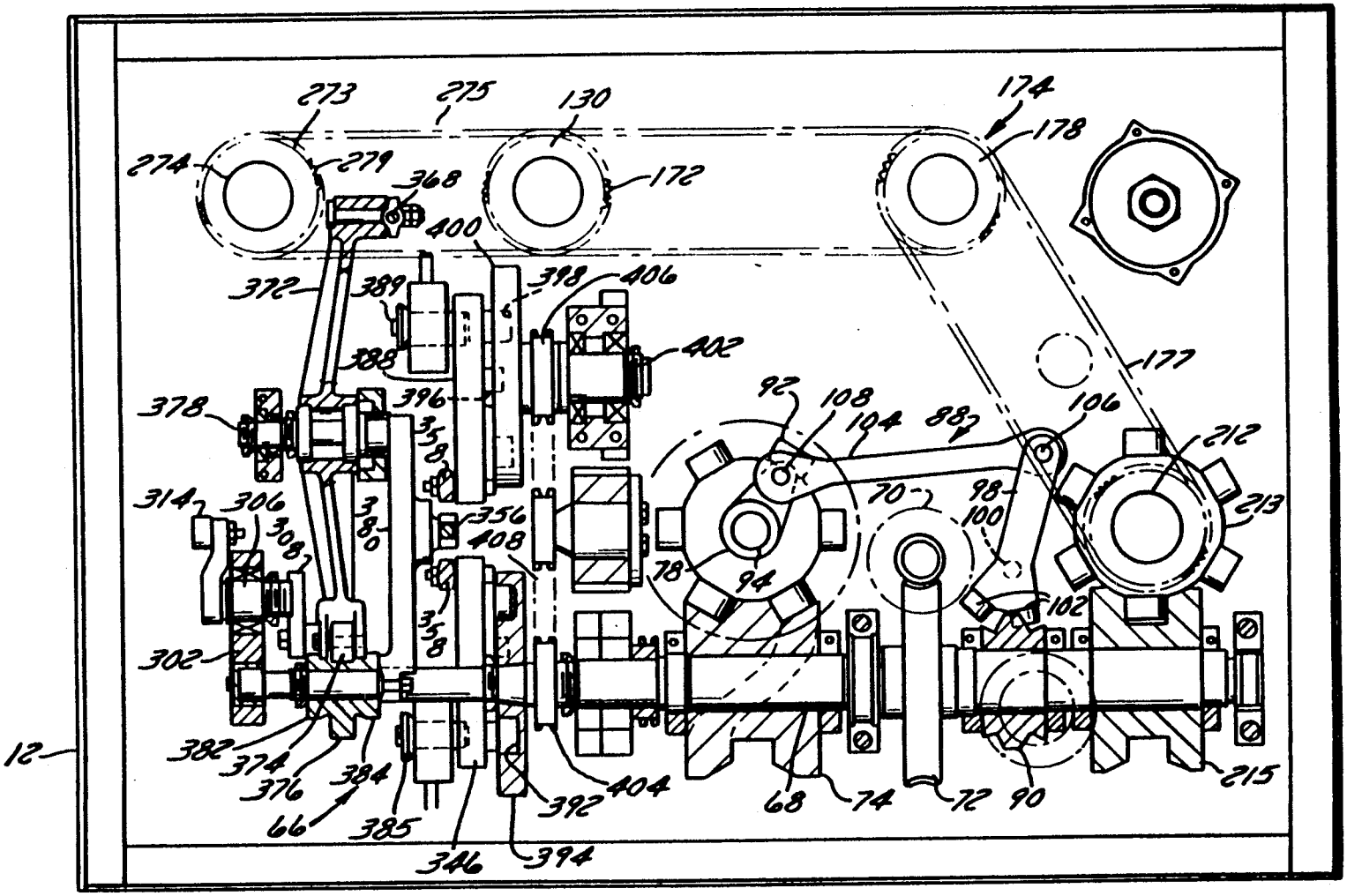
FIG. 12 is a cross-sectional view of the main drive assembly.
Figure 13:
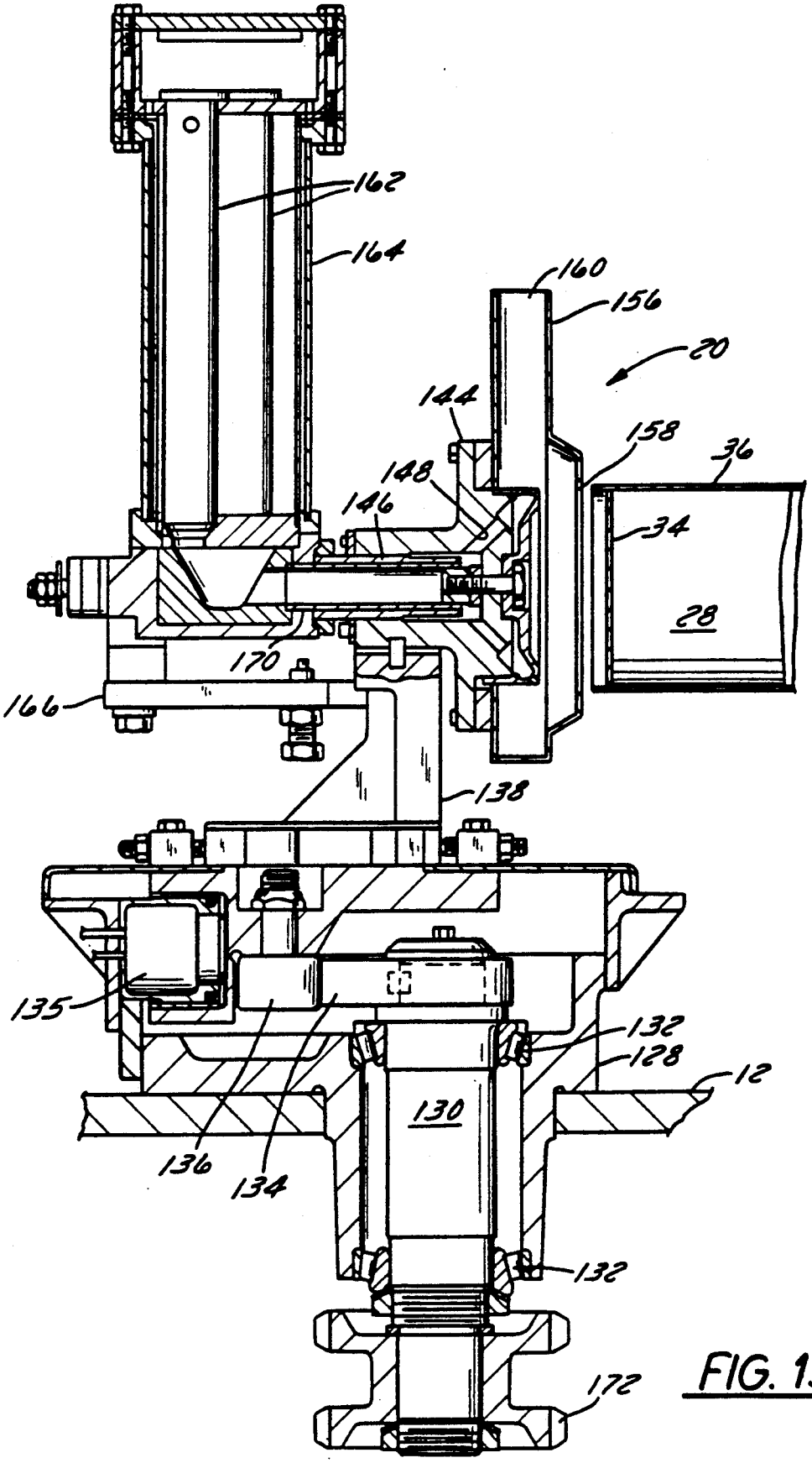
FIG. 13 is a cross-sectional view of the heat work station showing the bottom end of the cup.
Figure 14:
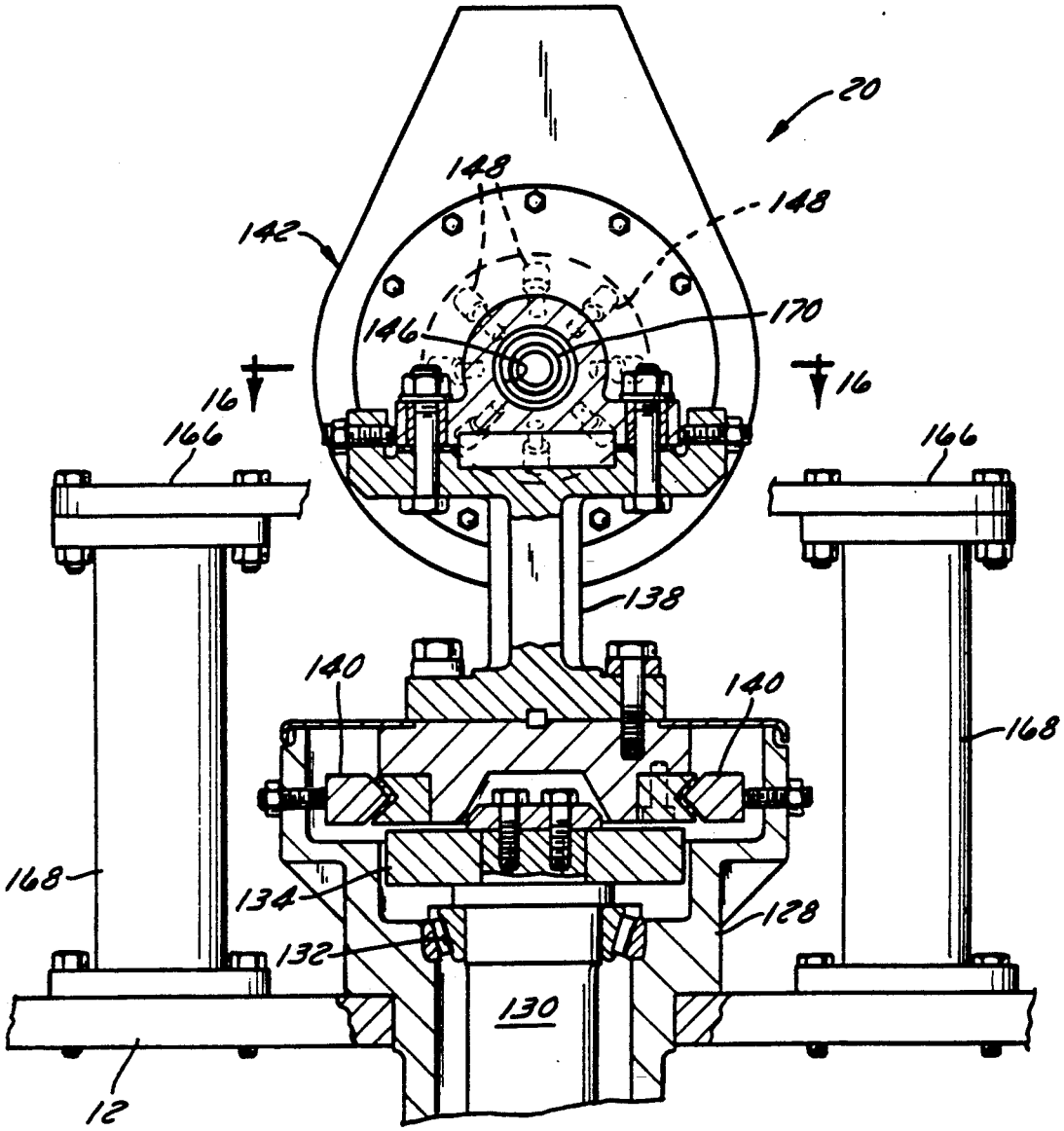
FIG. 14 is a cross-sectional view taken generally along line 14—14 of FIG. 13 showing the heater head of the heat station.
Figure 15:
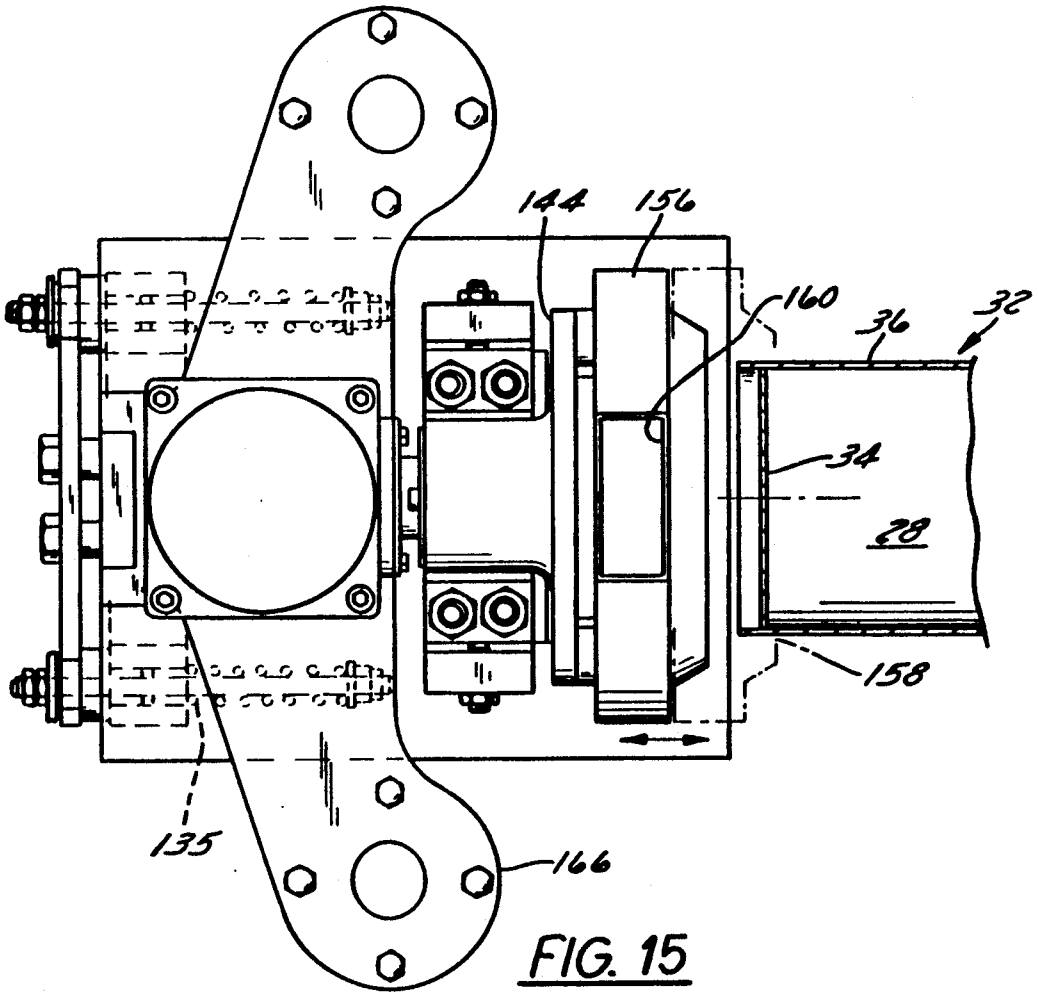
FIG. 15 is a top view of the heat station.
Figure 16:
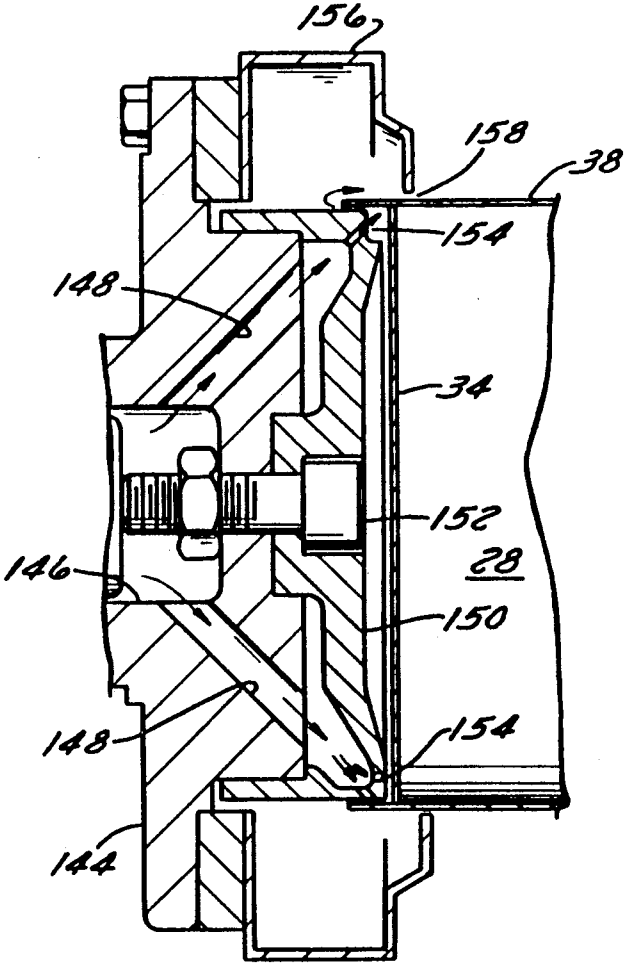
FIG. 16 is an enlarged cross-sectional view of the heater head taken on line 16—16 of FIG. 14.

Simultaneously with the step-by-step rotation of the turret 14, the cam plate 62 is reciprocated with the turret 14 by means of an oscillating linkage assembly 88 as shown in FIGS. 11 and 12. The assembly 88 is driven by a timing cam 90 which is mounted on the main drive shaft 68. The linkage assembly 88 is connected to an arm 92 provided on the end of a cam shaft 94 supported by roller bearings 96 within turret shaft 80. The linkage assembly 88 includes a cam follower arm 98 mounted for pivotal motion on a pin 100. A pair of cam rollers 102 are provided on the end of the arm 98 in a position to engage the timing cam 90. A link 104 is pivotally connected to the end of arm 98 by a pin 106. The other end of the link 104 is connected to the arm 92 on the lower end of the cam shaft 94 by a pin 108. The linkage is designed to move the cam plate 62 simultaneously with the stepping motion of the turret 14 and to return the cam plate 62 to its original position in timed sequence to the operation of the work stations as more fully described hereinafter.

Referring to FIGS. 9 and 10, the cam followers 58 for each of the mandrels 28 are shown generally in alignment with the radial axis of each of the work stations 16, 18, 20, 22, 24 and 26. When the turret 14 is rotated to move the mandrels to the next station, the cam plate 62 initially follows the motion of the turret 14. At the end of the rotation of the turret 14, the linkage assembly 88 returns the cam plate 62 back to its original position. On moving the cam plate 62 back to its original position, the cam follower 58 will follow the curve of the cam groove 64 which is designed to follow the motion of the work stations.

In this regard and referring specifically to FIG. 10, the radial axis of the work stations 16, 18, 20, 22, 24 and 26 are shown. The outer edge of the cams 58 at the work stations 16 and 18 will lie on the common circle "A" with the face of the mandrel 50 located at the same place for receiving the bottom disc 34 and side wall blank 38. When the mandrels 28 are advanced to the next station, the cam plate 62 will initially rotate clockwise with the turret 14. The cam plate 62 will then be rotated counter clockwise moving the cam follower 58 at the third work station 20 radially inwardly a distance "B" equal to the distance between the common circle "A" and the outer edge of cam groove 64. When the mandrel 28 at station 20 is indexed to the station 22 and the cam plate 62 reversed, the cam follower 58 at the station 22 will move radially inward the additional distance "C." Indexing the mandrel 28 and cam plate 62 to the station 24 and rotating the cam plate 62 back to its original position moves the mandrel inward the distance "D." When the mandrel 28 and cam plate 62 are indexed to station 26 and the cam plate 62 rotated back to its original position, the mandrel will move radially outward the distance "E." The mandrel 28 is then indexed back to the first station 16 and the cam plate 62 reversed, the mandrel 28 will move outwardly the distance "F" which is back to the starting position. Each of these movements "B," "C" and "D," are significant in the forming of the lip curl 45 simultaneously with the forming and sealing of the bottom disc 34 in the side wall blank 38.

OPERATION OF THE WORK STATIONS

At the first worker station 16, the bottom disc 34 is picked off the end of the bottom disc magazine 36 by means of a double arm vacuum pickup assembly 110. Each arm 112 includes a pair of vacuum cups 114 which are rotated into engagement with the bottom disc 34 at the end of the magazine. A bottom disc 34 is picked up and rotated into alignment with the end of the mandrel 28. Air is drawn through the sintered disc 59 to hold the disc 34 on the end of the mandrel 28. The vacuum opening 101A in the distributor plate 31 will be aligned with the opening 35 in the turret to draw a vacuum through the sintered plate 59 to hold the disc on the mandrel.

At the second or side wall blank work station 18 a vacuum pick-up assembly 118 picks up a side wall blank 38 from a magazine 40 and deposits the blank on a vacuum table assembly 120. The right and left ends 38A and 38B of the side wall blank 38 are heated and the blank 38 pushed under the mandrel 28 by means of a pusher assembly 122. The folding arm assembly 352 is activated to wrap the side wall blank 38 around the mandrel 28. The opening 103A will be aligned with the opening 37 in the turret to draw a vacuum on the surface of the mandrel to retain the side wall blank in engagement with the mandrel until the overlapped ends 38A and 38B of the blank are sealed. The heated ends are pressed into engagement by a block 126 to seal the ends together.

The third or heat station 20 as shown in FIGS. 13, 14, 15 and 16 is mounted on the frame or base 12 and generally includes a housing 128 which is mounted on the frame 12 and supports a drive shaft 130 for rotary motion on bearings 132. An eccentric cam 134 is mounted on the end of drive shaft 130 and is positioned to engage a cam follower 136 mounted on a slide bracket 138 which is supported in slideways 140 for longitudinal movement toward and away from the turret 144. The opening is aligned with opening in the turret plate to maintain a vacuum on the cup.

An air duct assembly 142 is supported on bracket 138 for movement toward and away from mandrel 28. The air duct assembly 142 includes a housing 144 mounted on the bracket 138 and having a cylindrical passage 146 aligned with a number of angularly outwardly directed air passages 148. A deflector 150 is secured to the end of housing 144 by bolt 152. The deflector 150 includes a number of openings 154 in the corner for directing air outwardly from the deflector 150. A hood 156 is mount®d on the end of housing 144 to enclose the deflector 150. An opening 158 is provided in the front face of the hood 156 in alignment with the mandrel 28. An exhaust passage 160 is provided in the top of the hood 156.

A number of 6000 watt electric heaters 162 are mounted in a cylindrical housing 164 which is secured to a bracket 166 supported on columns 168 which are secured to the frame 12. A nozzle 170 is provided at the lower end of the heater housing 164 which is aligned with the cylindrical opening 146 in housing 144. Air blown through the housing 164 passes the electric heaters 162 and flows through nozzle 170 and passages 146 and 148 in housing 144. The hot air passes through the openings 154 and is directed at the inside surface of the side wall blank 38 to heat the thermoplastic surface.

In operation, the shaft 130 is driven by means of a double drive sprocket 172 mounted on the end of shaft 130. The drive gear 172 is driven by the chain drive assembly 174 shown in FIG. 12. The bracket 138 is biased toward the mandrel 28 by means of an air spring 135 mounted on bracket 128. On rotation of cam 134, the cam follower 136 will follow the surface of cam 134 due to the bias force of the pressurized air spring 135 on the forward stroke and the cam follower 136 will withdraw the hood 156 from the ®nd of the side wall blank on the return stroke. In the event of an emergency stop, a vacuum will be drawn in the air spring 136 to withdraw the hood 156 from the cup to prevent burning of the bottom edge of the cup.

With this arrangement, the tooling plate 196 is moved toward the mandrel 28 by the rotation of cam 182A against cam roller 205 and is withdrawn by the engagement of cam 182B with cam roller 207 to provide positive movement of the tooling die 198 in both directions. It should be noted that the timing of the movement of the heat station 20, wind station 22 and rimming station 24 is synchronized with the movement of the mandrels 28 toward the curling die 30. The stations 20, 22 and 24 are moved into operative engagement with the mandrels 28 and continue to move with the mandrels 28, as the mandrels are moved toward the curling die 30.

The bottom incurl and finish station 22 as seen in FIGS. 17, 17A, 18 and 19 includes a housing 176 Which is mounted on the base frame 12. A drive shaft 178 is supported in the housing 176 by roller bearings 180. A double cam 182A and 182B is mounted on one end of the shaft 178 which is driven by a double drive sprocket 179 mounted on the other end of shaft 178. The drive sprocket 179 is driven by the chain drive assembly 174 as shown in FIG. 12. A tooling plate 184 is mounted for sliding movement on slideways 186 mounted on each side of the housing 176. A pair of cam followers 205 and 207 are mounted on the tooling plate 184 in a position to engage cams 182A and 182B, respectively. A bracket 188 is mounted on the tooling plate 184 to support a housing 190. A die holder assembly 192 is mounted in the housing 190 for movement into engagement with the mandrel 28.

The die holder assembly 192 is supported for linear movement in housing 190 by a cylindrical member 191 mounted for sliding movement in bearing rings 193. The cylindrical member 191 is supported on a rod 197 and biased outwardly by a spring 199 mounted in a bore 201 in cylindrical member 191. The holder assembly 192 includes a plate 196 for supporting a hot water manifold 195. A tooling die assembly 198 is supported for sliding movement on die guides 199 mounted on the plate 196. The tooling die 198 is biased by spring 210 toward the end of the mandrel 28.

The manifold 195 is aligned in a groove 203 in the face of head 194. The manifold 195 is supported in the groove 203 by arcuate support members 209 and 211 secured to the front of plate 196. A passage 200 is provided through the manifold 195, the upper support member 209 and the plate 196. Cold water is circulated through the passage 200 to cool the manifold 195 and the heated edge 42 of the cup.

Figure 17:
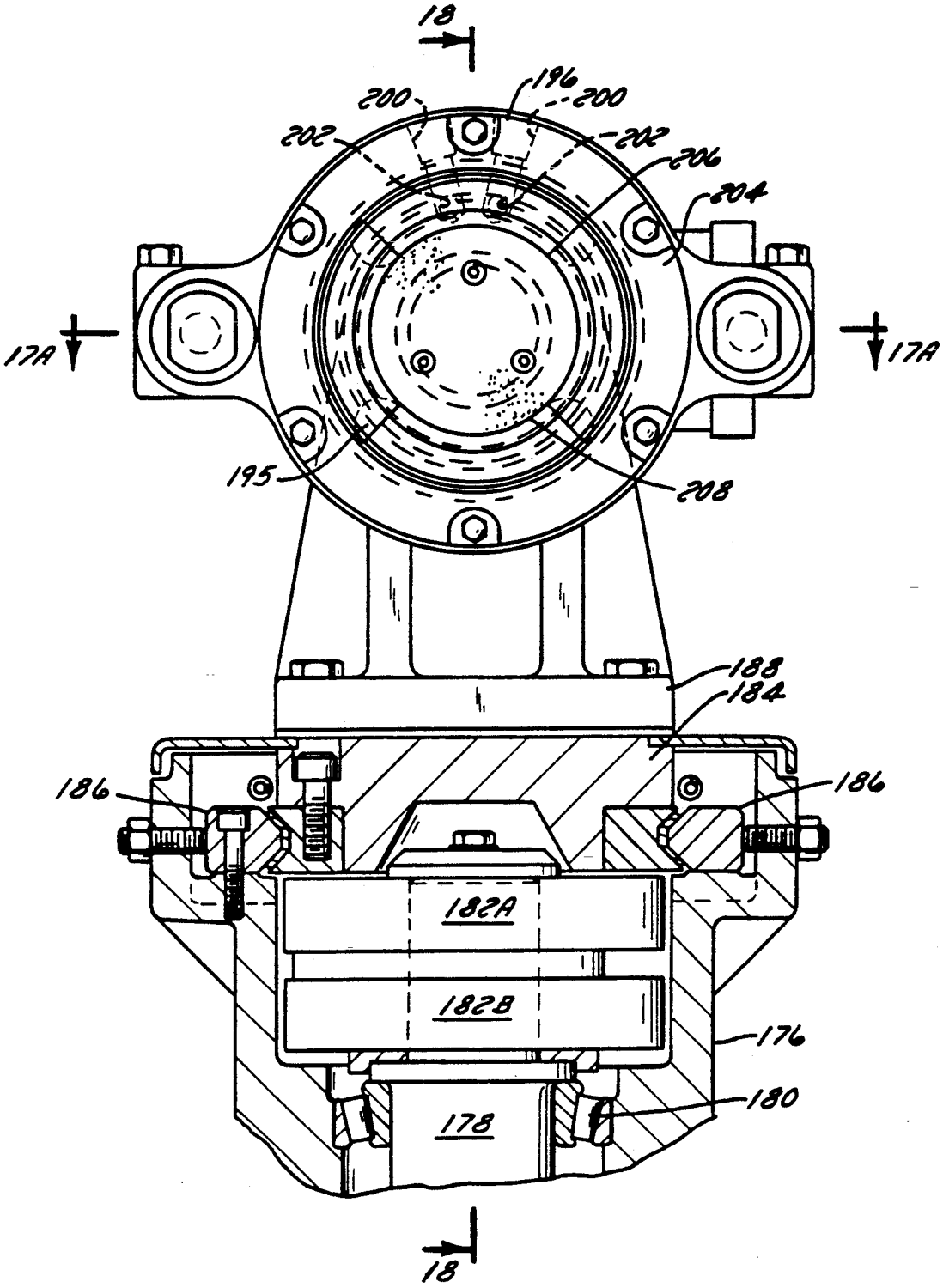
FIG. 17 is a front view partly in section of the bottom incurl and finish work station.
Figure 17A:
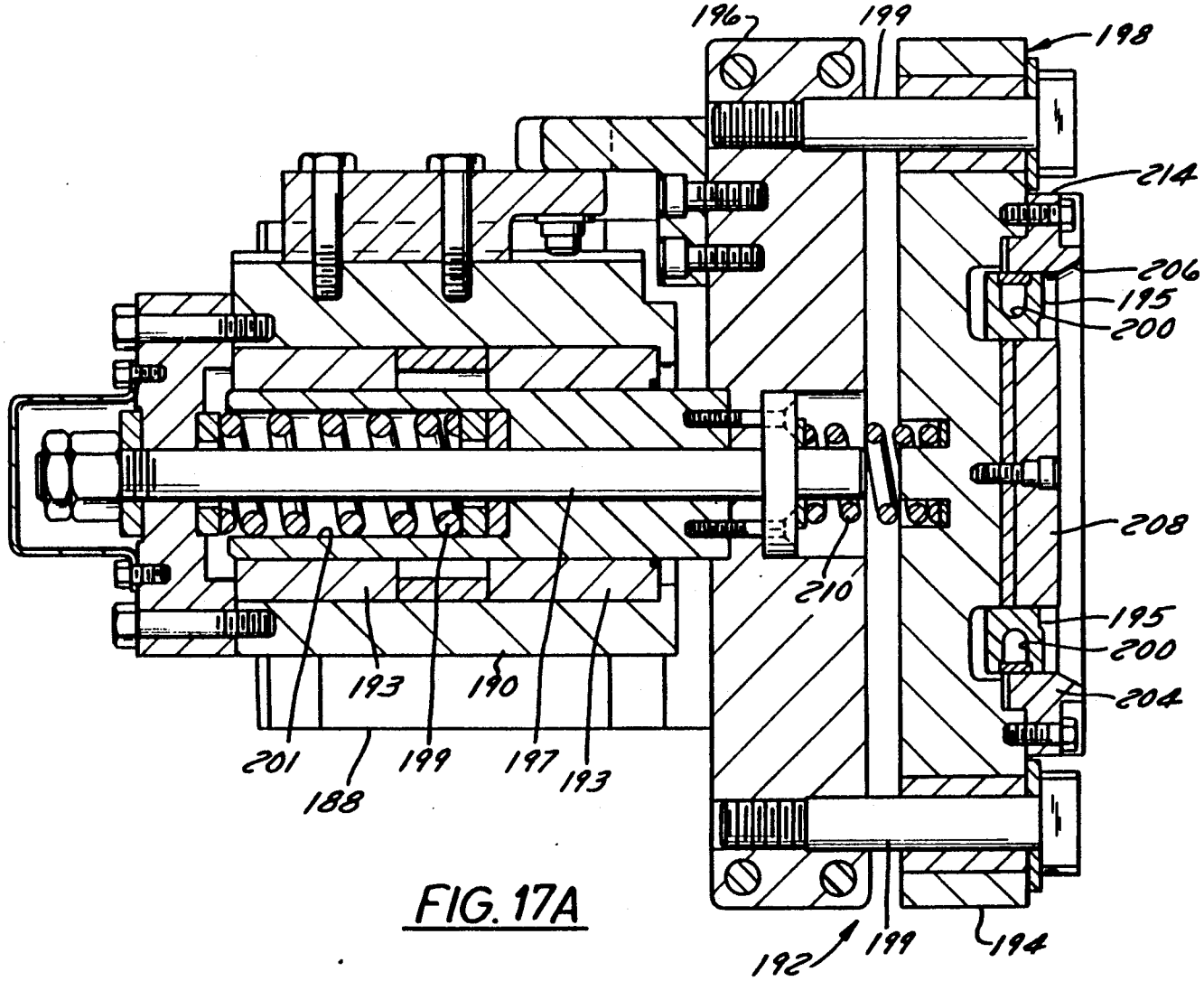
FIG. 17A is a cross-sectional view taken on line 17A—17A of FIG. 17.
Figure 18:
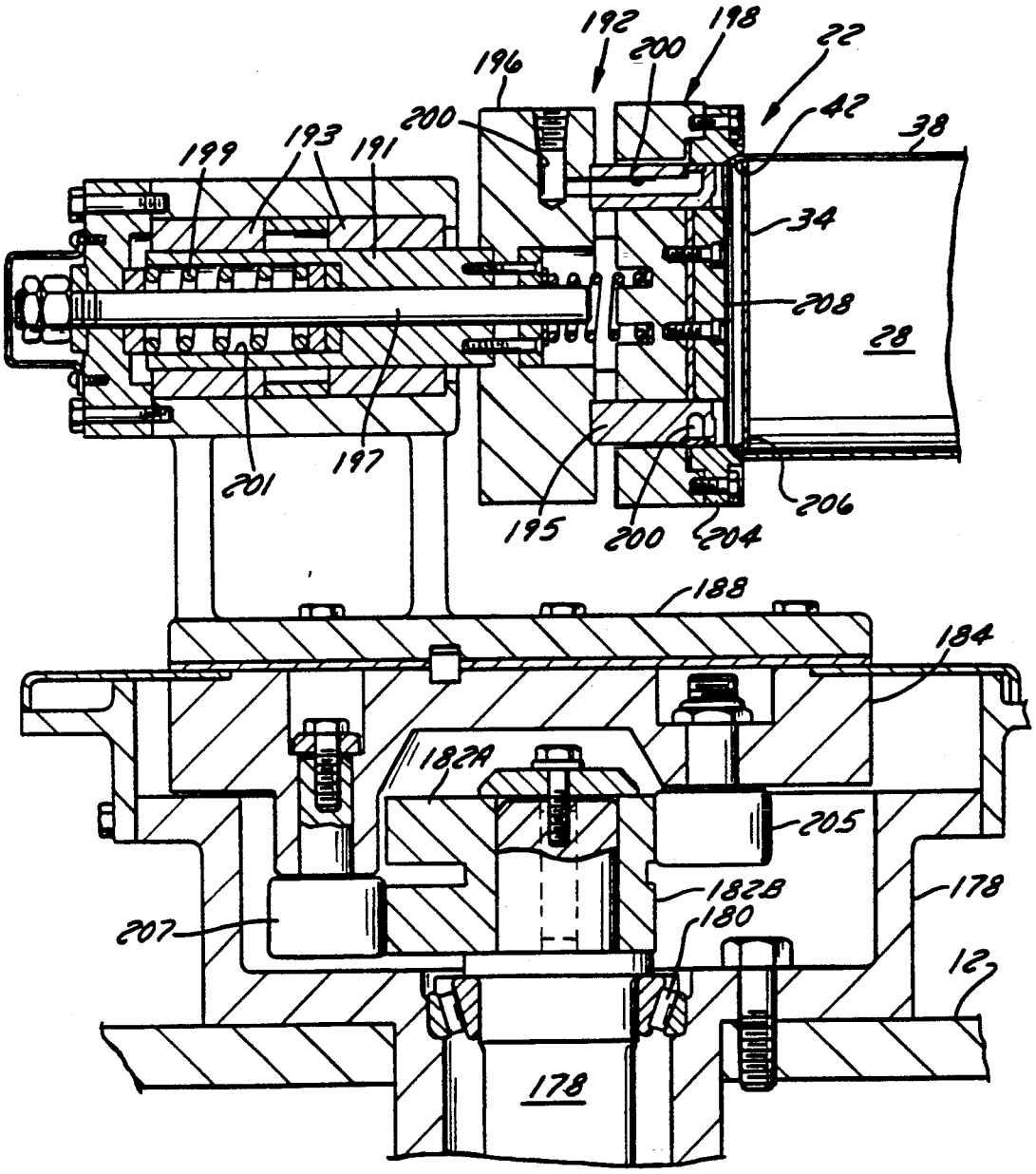
FIG. 18 is a cross-sectional view taken generally along line 18—18 of FIG. 17 showing the double cam assembly for controlling the radial movement of the bottom incurl and finish station.
Figure 19:
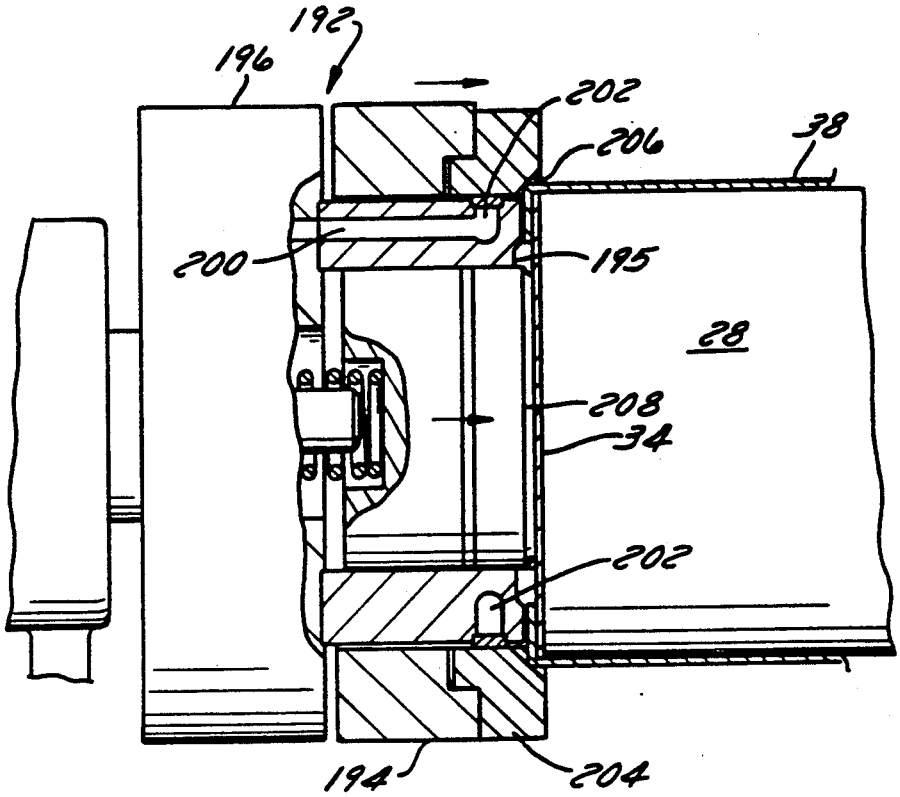
FIG. 19 is a view incurl head partly broken away to show the incurl die.

Referring to FIGS. 17, 17A, 18 and 19, the tooling die assembly 198 includes a head 194 for supporting a circular die 204 having a beveled edge 206 around the inside of the die 204. When the tooling plate 184 is moved toward the mandrel 28, the beveled edge 206 on the die 204 will engage the bottom edge, 42 of the side wall blank 38 folding it inwardly. The head 194 stops when the center 208 of the head 194 is seated on the bottom disc 34 as shown in FIG. 17A. Continued movement of the tooling plate 184 will move the cold water manifold 195 into engagement with the partially folded edge 42 of the side wall blank 38 moving the edge 142 into abutting engagement with the bottom disc 34. Cooling of the manifold 195 will enhance the cooling of the seal of the edge 42 against the bottom disc 34.

Figure 22:
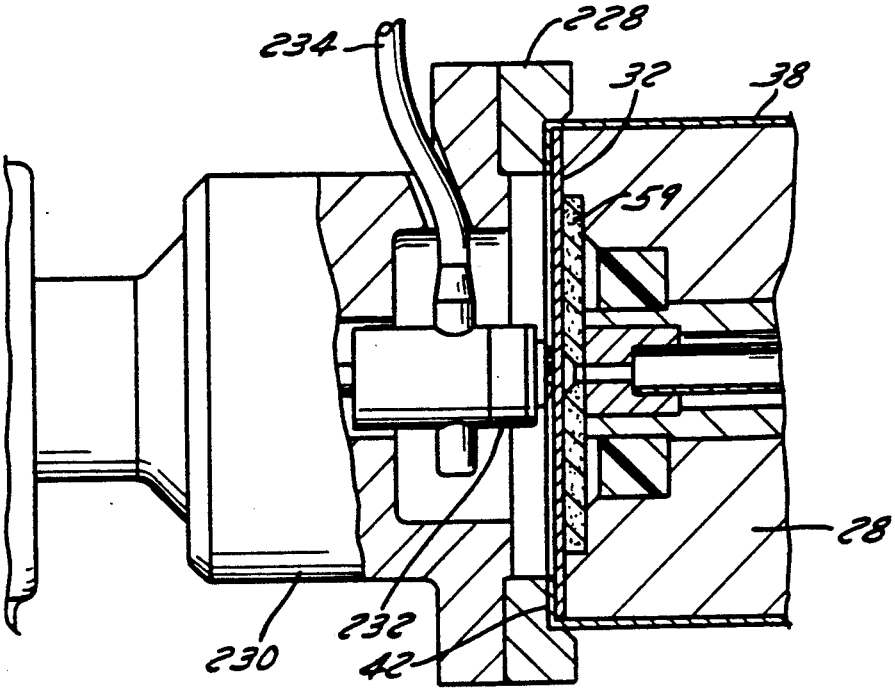
FIG. 22 is an enlarged view of rimming station partly in section shown seated on the cup.
Figure 20:
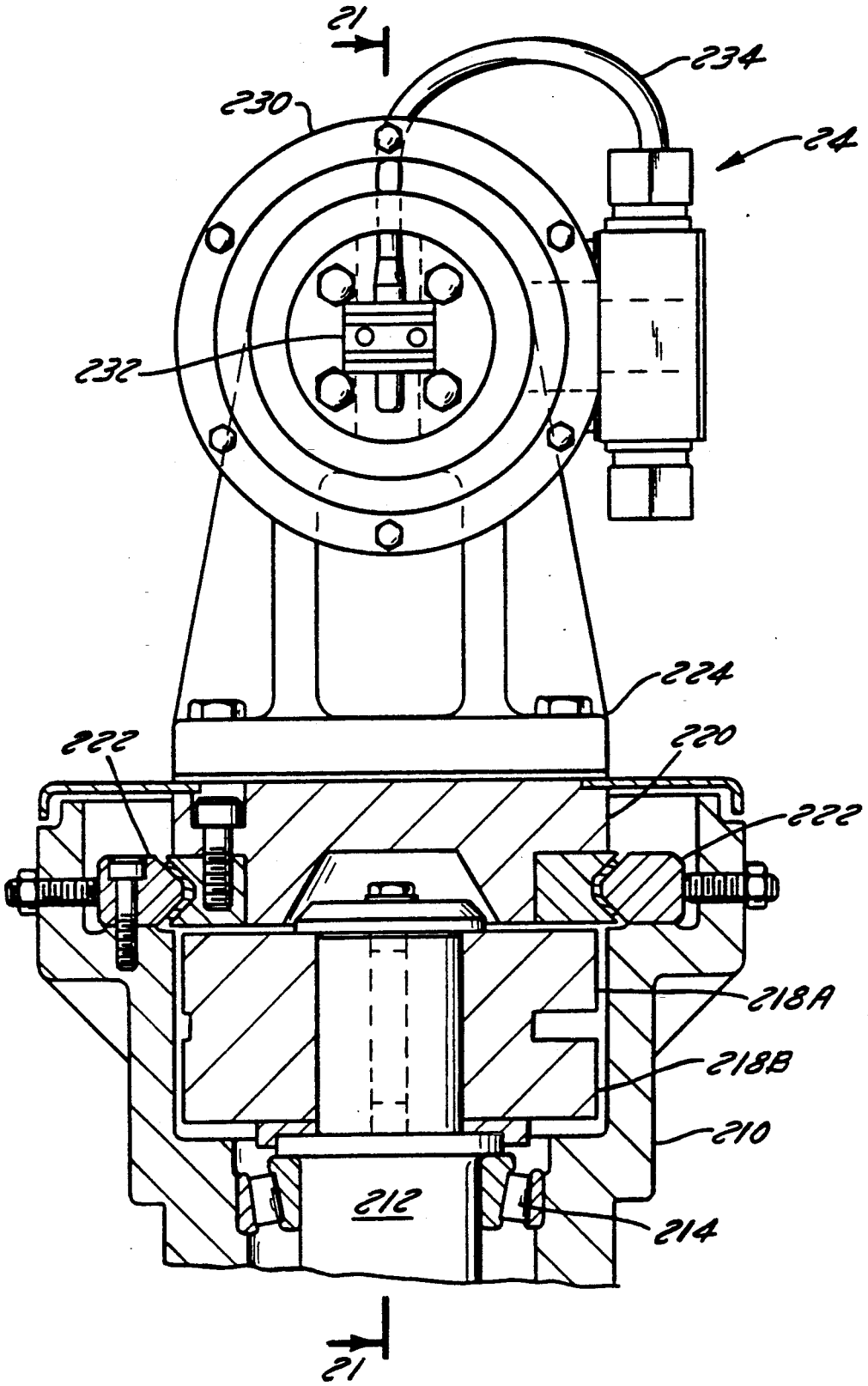
FIG. 20 is a front view partly in section of the rimming station.
Figure 21:
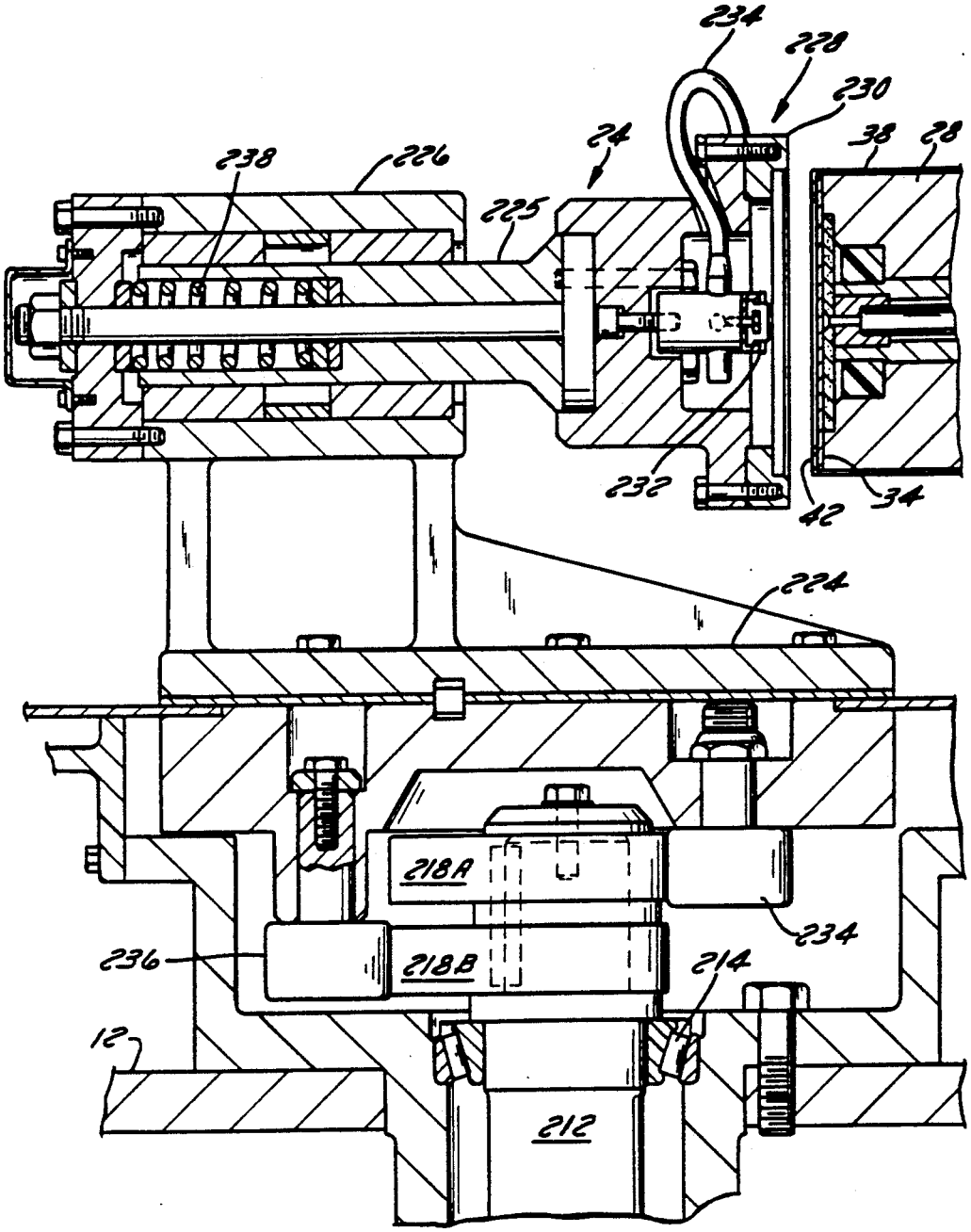
FIG. 21 is a cross-sectional view taken generally along line 21—21 of FIG. 20 showing the cam assembly for moving the rimming station in a radial direction.

The rimming station 24, as seen in FIGS. 20, 21 and 22, is supported on the base 12 by a housing 210. A drive shaft 212 is supported for rotary motion in the housing on bearings 214 and is operatively connected to a double cam 218A, 218B in housing 210 at one end and to a stepping cam follower 213 which is driven by a drive cam 215 as shown in FIG. 12 mounted on shaft 68 on a one-to-one ratio. A tooling plate 220 is supported for sliding movement on slideways 222. A bracket 224 is mounted on tooling plate 220 and supports a housing 226. A rimming head assembly 228 is supported by a cylindrical member 225 for axial movement in the housing 226. The rimming head assembly 228 includes a rimming head 227 having a tooling die 230 supported on the rimming head 227 for movement into engagement with the end of the mandrel 28. A hot plate 232 is mounted in the center of the tooling die 230 to burn an identifying number in the bottom disc 34 of the cup 32. The plate 232 is electrically heated by means of a cable 234. The rimming head 228 is moved into engagement with the end of the mandrel 28 by means of the cams 218A and 218B which are positioned to engage cam followers 236 and 238 on the tooling plate 220. The cam 218A provides positive engagement with follower 234 to move the head toward the mandrel and the cam 218B provides positive movement away from the mandrel on engagement with the follower 236. A spring 238 is provided in one end of the member 225 to bias the tooling die 230 into engagement with bottom disc 34 of the cup as shown in FIG. 22.

It should be noted in FIG. 12 that the heater station 20, incurl station 22 and rimming station 24 are driven simultaneously by chain drive assembly 174. In this regard and referring to FIG. 12, the rimming station drive shaft 212 includes a drive sprocket 217 which is connected to the double drive sprocket 179 at the incurl station by a chain 177. The drive sprocket 179 is also connected to the double drive sprocket 172 at the heat station 20 by a chain 173. With this arrangement, each of the work stations 22, 24 and 26 are simultaneous driven through one full cycle in each revolution of the drive shaft 68.

At the final or "blow off" station as shown in FIGS. 22 and 23, the cup 32 is blown off the mandrel 28. In this regard, air is blown through the inner channel 47 in shaft 54, through opening 53 and recesses 61 and sintered plate 59 to eject the finished cup from the mandrel.

VACUUM/PRESSURE DISTRIBUTOR

Figure 9B:
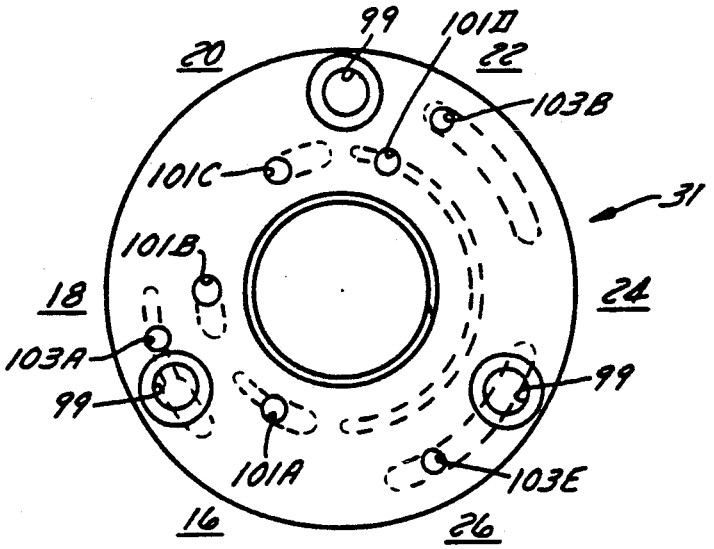
FIG. 9B is a top view of the distributor plate.
Figure 9A:
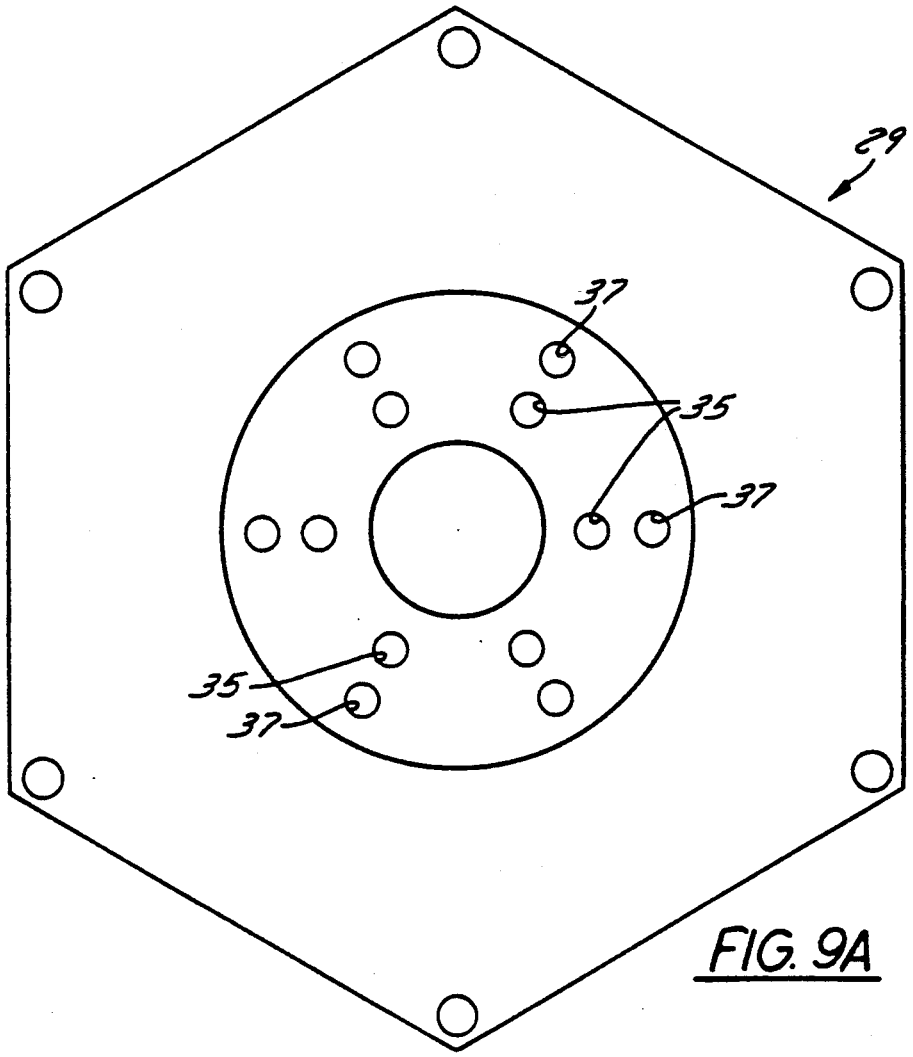
FIG. 9A is a top view of the turret cover.

Referring to FIGS. 9, 9A, 9B and 23 the vacuum or air pressure required at the end of the mandrels 28 is controlled by means of a cover plate 29 mounted on the top of the turret 14 and a distributor plate 31 mounted on the top of the cover plate 29. A fiberglass ceramic pad 33 is mounted on the cover plate to allow the turret to rotate with respect to the distributor plate. It should be noted that the cover plate 29 and pad 33 each having two holes 35, 37 located on the radial axis of each of the work stations. Each hole 35 and 37 is connected to a corresponding hole 39, 41 on the shaft 54 by tubing 43, as shown in FIG. 9, 9A and 9B. The shaft 54 includes an inner channel 47 and an outer channel 49 which are connected to the corresponding holes 39 and 41, respectively. The inner channel 47 terminates in a distribution block 51 having a central opening 21 and crisscross recesses 61 facing the sintered block 59. The outer channel 49 is connected to a number of radial openings 91 in the mandrel cap 50 which terminate in longitudinal grooves 93 provided on the periphery of the mandrel cap 50. Depending on the position of the mandrel with respect to the work stations, either a vacuum or a pressure surge can be introduced into the shaft 54 through the openings 35 and 37.

The distributor plate is provided with a plurality of openings 101 and 103 which lie in the circle of revolution of the holes 35 and 37, respectively. Each of the holes 101 and 103 are permanently connected to either a source of vacuum or a source of pressure depending on the requirement of the particular work station. In this regard, holes 101A, 101B, 101C and 101D are connected to a source of vacuum to hold the bottom disc 34 on the mandrel at the various work stations 16, 18, 20 and 22. The hole 103A and 103B are also connected to a vacuum source to hold the side wall blank 38 on the mandrel at stations 18 and 22. The hole 103E at the blow-off station is connected to an air pressure source for blowing the finished cup off the mandrel.

The distributor plate 31 as shown in FIG. 9B is restrained from rotating by posts 95 which are mounted in the head 97 on the top of the turret 14. The posts 95 are aligned with recesses 99 in the top of the distributor plate 31 with springs 103 mounted on the posts 95 to bias the distributor plate into engagement with the pad 33 on the top of plate 31. Each of the openings 101 and 103 in the distributor plate 31 is connected to a pressure source or a vacuum source in the head as required at each of the work stations.

SIDE WALL BLANK FEEDER

Figure 25:
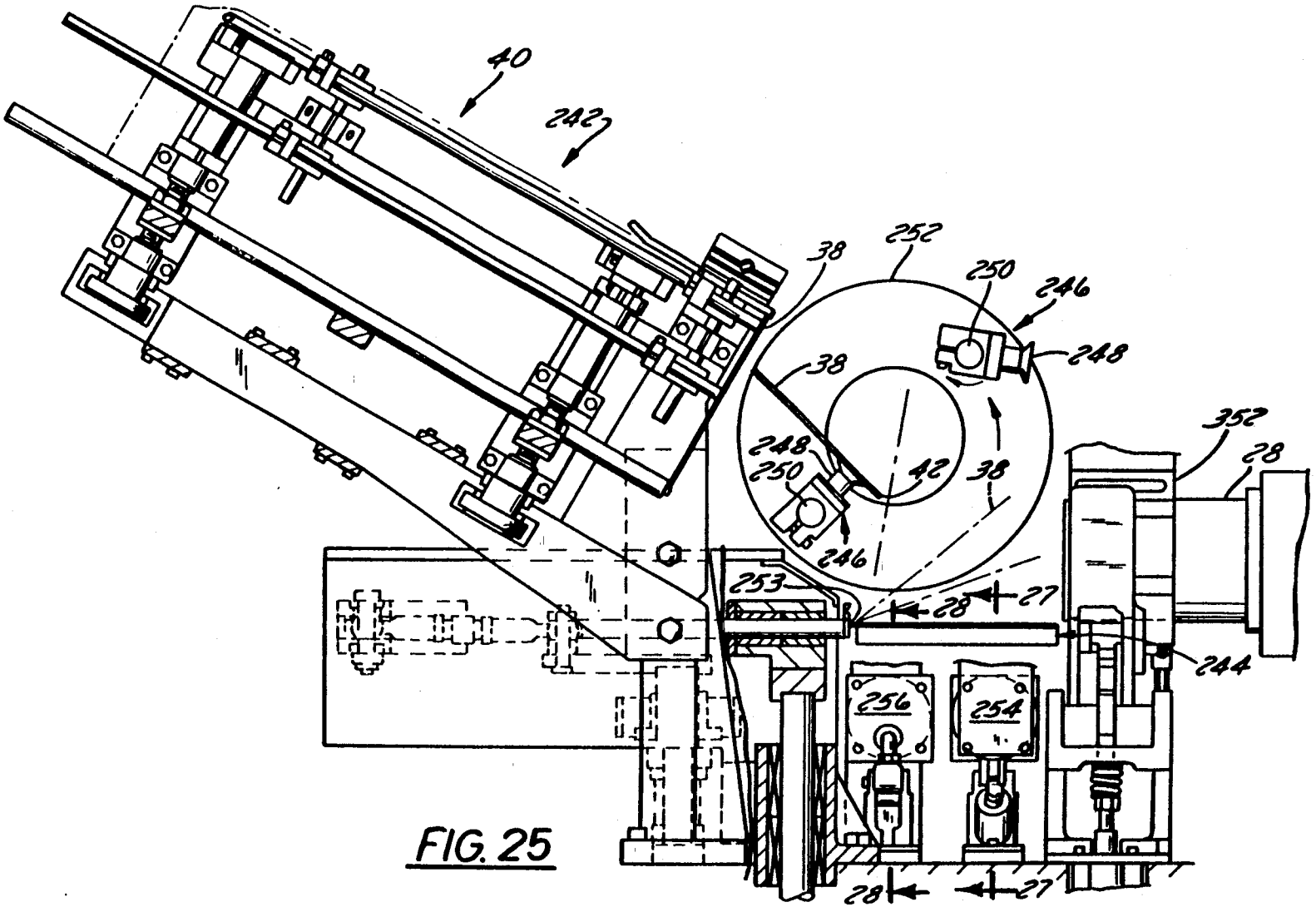
FIG. 25 is a side view partly in section of the side wall blank feeder assembly.
Figure 26:
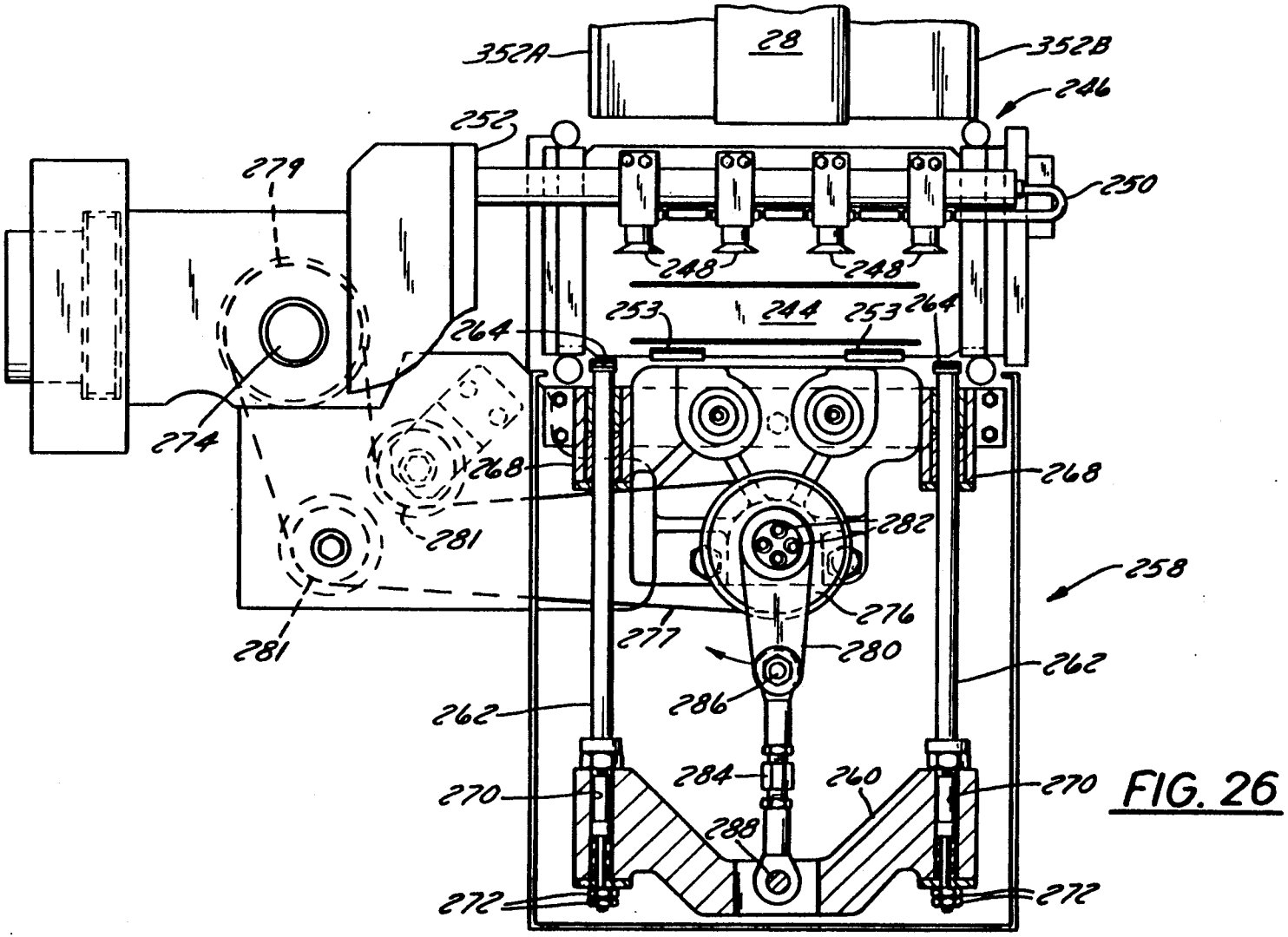
FIG. 26 is a top view of the side wall blank pusher station.

Referring to FIGS. 25 and 26, the side wall blanks 38, as noted above, are stored in the magazine or hopper 40 which is located at the second or side wall folder station 18. A vacuum plate assembly 244 is positioned between the end of the hopper 242 and the mandrel 28. A pair of vacuum pick-up assemblies 246, each having a number of suction cup shaped members 248, four in number, are mounted on a vacuum tube 250 that is connected to a vacuum system (not shown). The tubes 250 rotate the cups 248 into engagement with the side wall blank 38 on the end of feed hopper 242 to pick up a side wall blank 38 by vacuum, transfer it to the vacuum plate assembly 244 where the blank is released by relieving the vacuum as the cup approaches the plate assembly 244. It should be noted that the drive wheel 252 rotates counter clockwise in FIG. 25 and the suction cup assemblies 246 rotate clockwise so that the suction cup 238 rotates into engagement with the blank 38. The rotation of the suction cups 286 carries the blank to the vacuum plate assembly 244. The bottom edge 42 of the blank 38 engages a pair of stops 253 on the vacuum plate assembly as the vacuum in the suction cups 286 is relieved allowing the blank 38 to fall on the vacuum plate assembly 244. The vacuum plate assembly 244 includes a plate 252 having a number of rows of tubes 250 aligned with the bottom of the plate 252 which draw a vacuum through perforation 255 in plate 252 to hold the blank 38 on the plate 252 as the ends of the blank 38 are heated.

Figure 27:
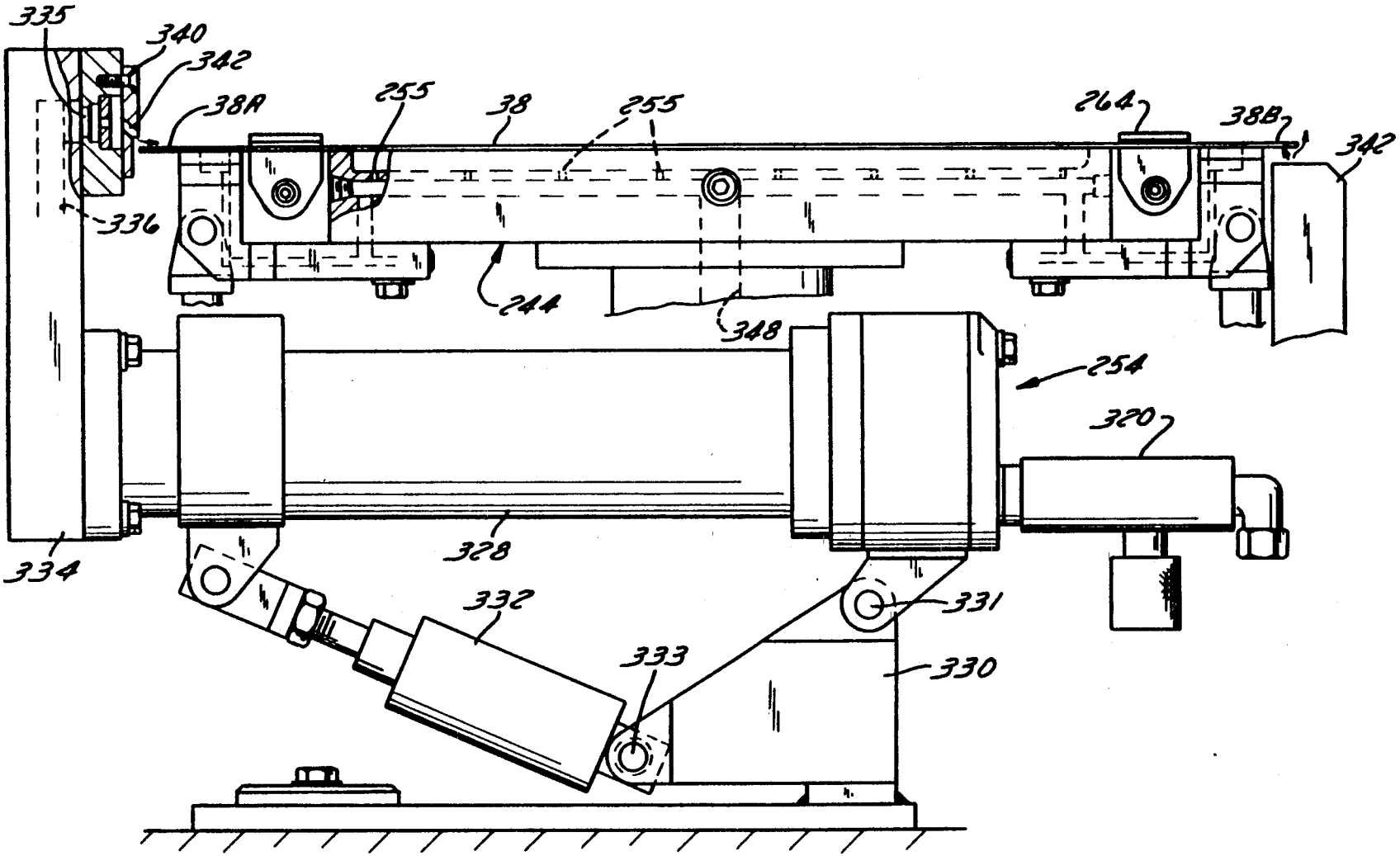
FIG. 27 is a view of the side wall blank upper end heater assembly.
Figures 28, 29:
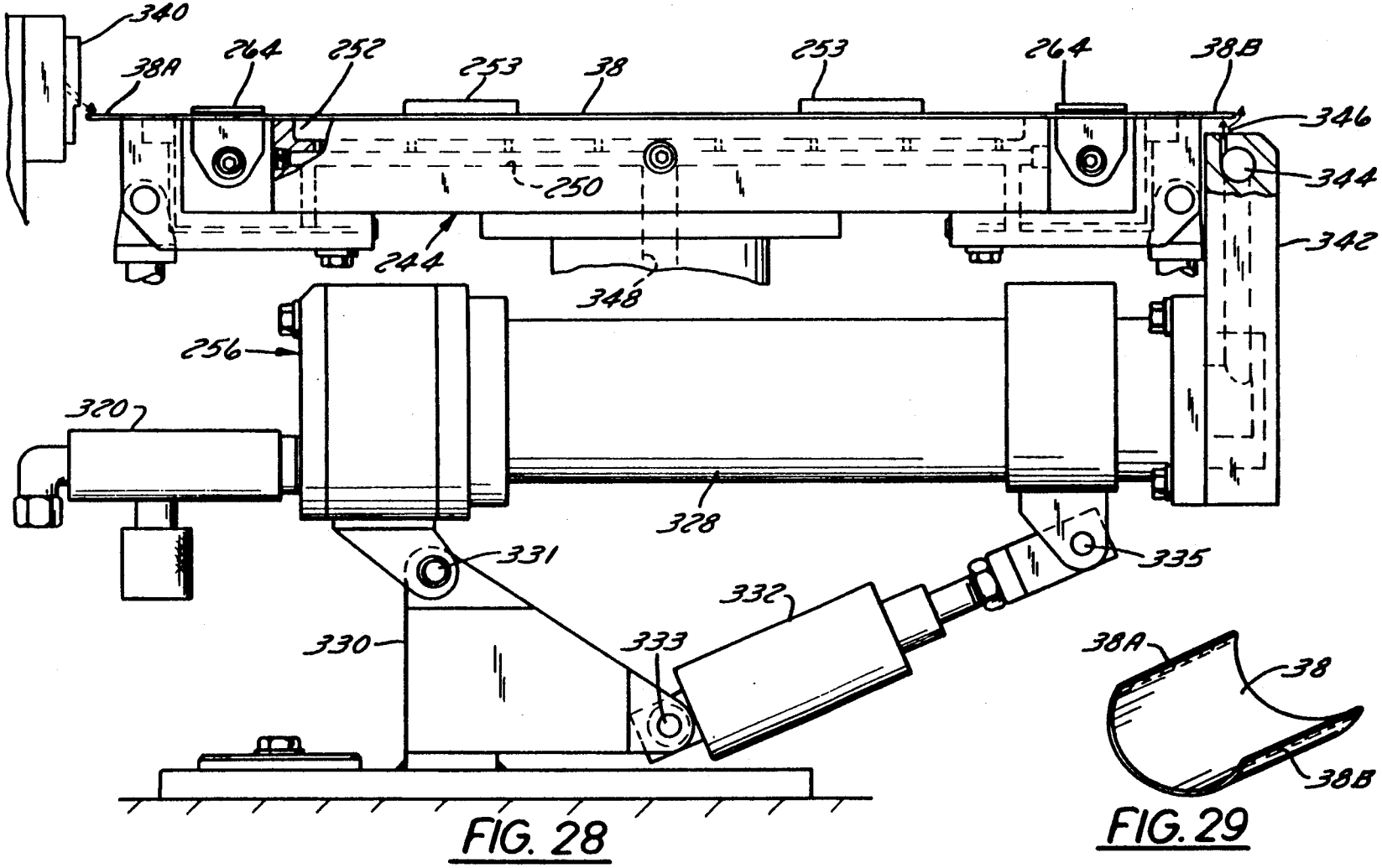
FIG. 28 is a view of the side wall blank lower end heater assembly.
FIG. 29 is a perspective view of the side wall blank showing the heated ends of the sidewall blank.

A heater assembly 254 as shown in FIG. 27 is provided beneath the plate 252 to heat the top of the end 38A of the blank 38. A heater assembly 256 as shown in FIG. 28 is provided beneath the plate 252 to heat the bottom of the opposite edge 38B of the blank 38. The blank 38 is pushed under the mandrel 28 by a pusher rod assembly 258, FIG. 26, which engages the edge of the side wall blank 38 to push the blank into alignment with the mandrel 28. Simultaneously with the movement of the side wall blank 38 into alignment with the mandrel, the other vacuum cup assembly 246 deposits another side wall blank 38 onto plate 252.

PUSHER ROD ASSEMBLY

Figure 30:
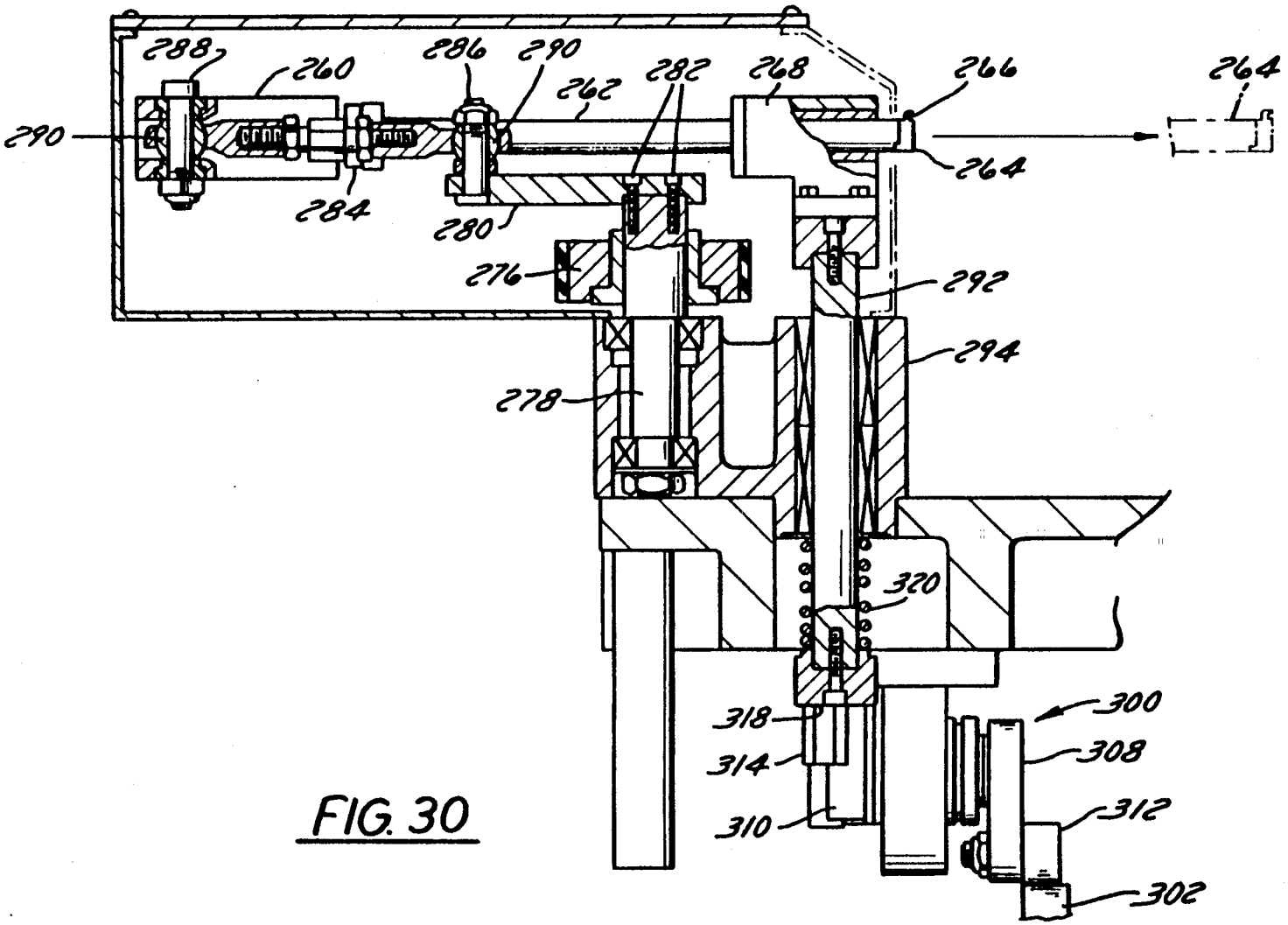
FIG. 30 is a view partly in section of the pusher rod assembly in the start position.
Figure 31:
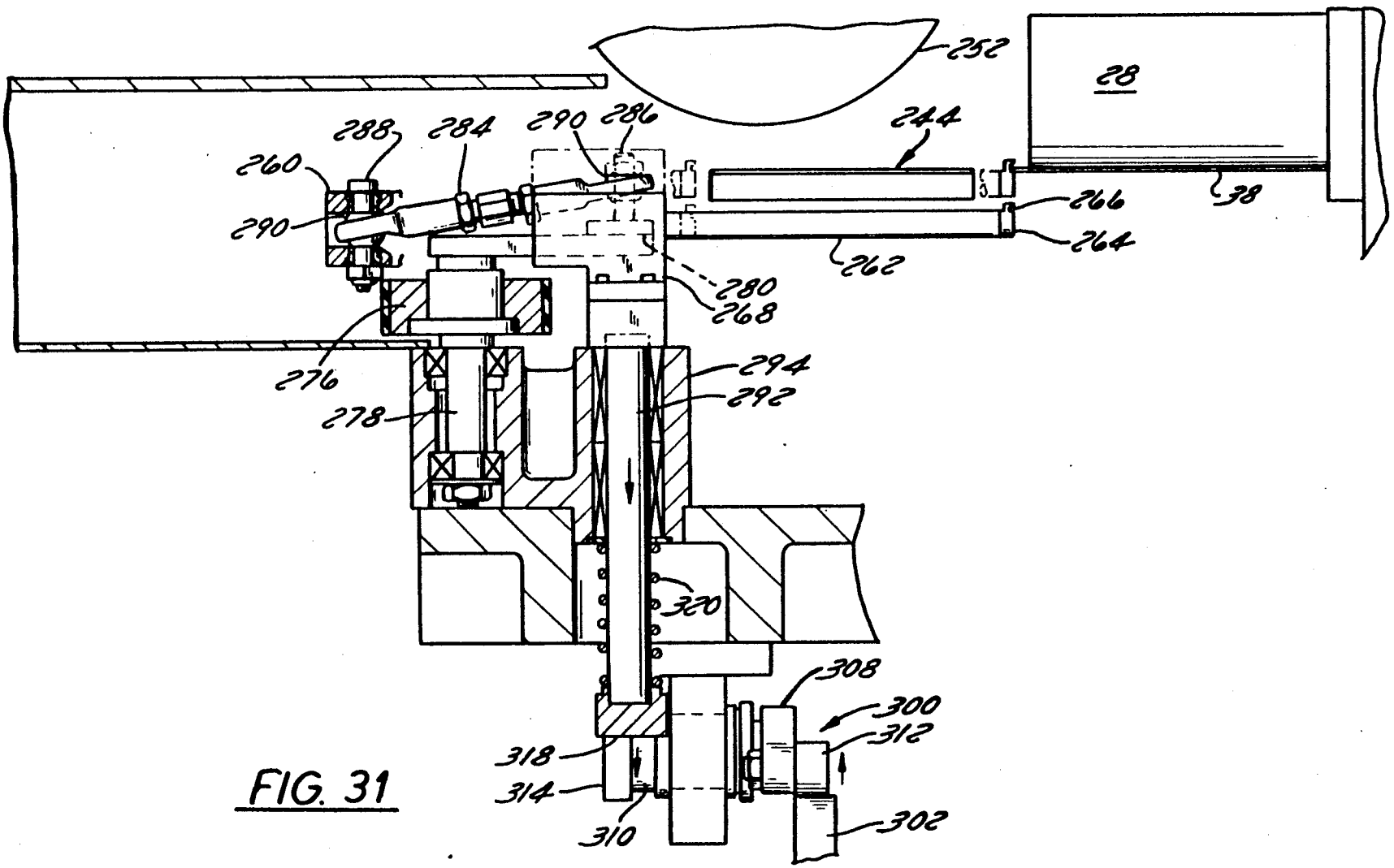
FIG. 31 is a view similar to FIG. 30 showing the pusher rod assembly in position for return.
Figure 33:
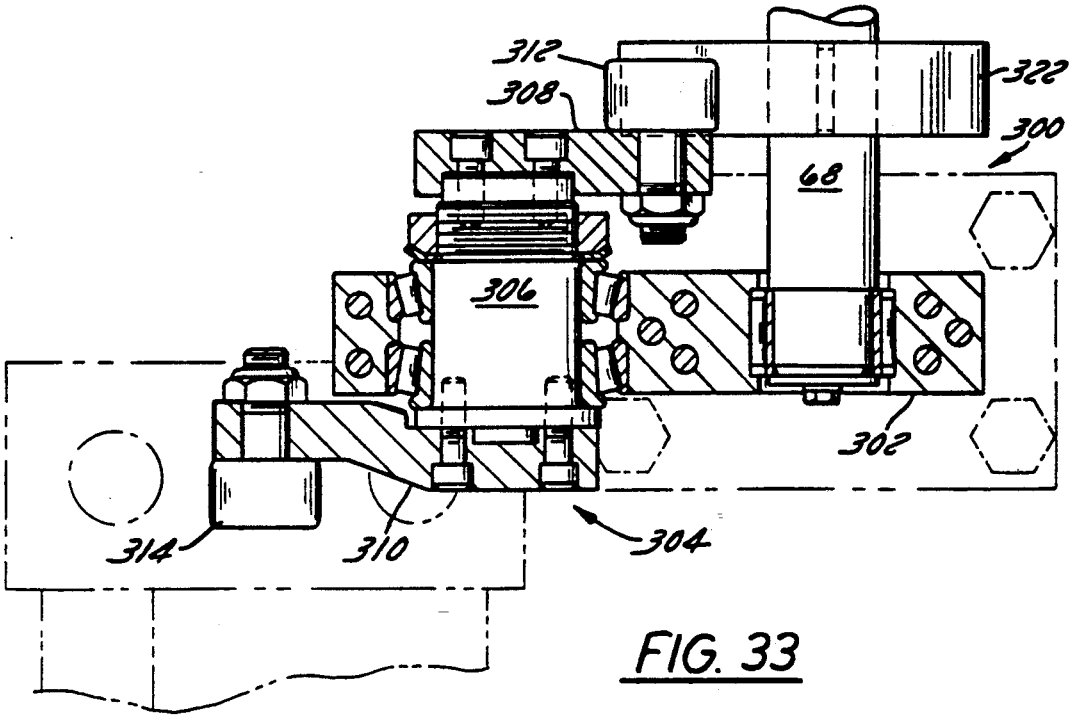
FIG. 33 is a top view partly in section of FIG. 32.
Figure 32:
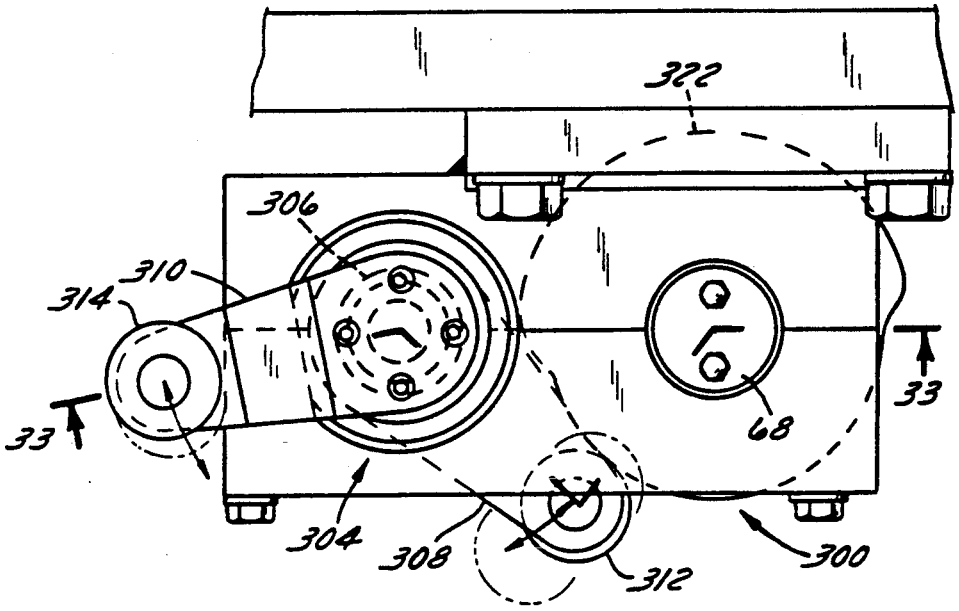
FIG. 32 is a side view of the rocker arm assembly for actuating the pusher rod assembly.

The pusher assembly 258 as shown in FIGS. 26, 30 and 31 includes a cross over member 260 which is provided with a pair of pusher rods 262 each of which includes a head 264 having a groove 266 on the end to engage the bottom edge 42 of the blank 38. The pusher rods 262 are slidably disposed in a pair of bearing assemblies 268 which guide the alignment grooves 266 into registration with the edge 42 of the blank 38 when the blank is to be pushed from plate 252 onto the folding wing assembly 352 under the mandrel 28. The biasing assemblies 268 drop the heads 264 below the table on the return motion of the pusher rods 262.

Crossover member 260 includes a pair of bores 270 for receiving pusher arms 262. Each pusher arm 262 is longitudinally adjustable within its respective bore 270 so that the positioning of the alignment grooves 266 may be adjusted with respect to the edge 42 of the side wall blank 38. A pair of threaded adjustment nuts 272 on each pusher arm 262 allows the longitudinal position of the pusher arm to be changed with respect to crossover member 260 as well as the edge of blank 38.

The reciprocal motion of pusher assembly 258 is controlled by a drive shaft 274 having a drive sprocket 273 at one end that is driven off the chain drive assembly 174 by a chain 275 connected to sprocket 172 as shown in FIG. 12. The drive shaft 274 is connected to a drive pulley 276 affixed to drive shaft 278 by means of a belt 277 which passes around a pulley 279 mounted on shaft 274 and belt tightener pulleys 281. A drive arm 280 is attached to shaft 278 by bolts 282. The distal end of drive arm 280 is connected to a link 284 by a pin 286. Link 284 is also connected to crossover member 260 by a pin 288. Link 284 is pivotally connected to pins 286 and 288 by ball joints 290 as shown generally in FIGS. 30 and 31.

As drive shaft 278 rotates, drive arm 280 rotates about drive shaft 278 and rotates pin 286 around shaft 278. Pivotal link 284 converts the arcuate travel of pin 286 into the reciprocating longitudinal movement of pin 288 which drives crossover member 260 and pusher arms 262. Thus, during one half of the rotation of shaft 278, pusher arms 262 are moved longitudinally inward toward the turret 14 in order to bring alignment grooves 266 into registration with the side wall blank 38 and push the blank from table 244 onto the folding wing assembly 352. During the second half of the rotation of drive shaft 278, drive arm 280, in cooperation with link 284, moves crossover member 260 and pusher arms 262 back to their initial position, so that alignment grooves 266 are once again ready to be moved into registration with the next blank during the next forward cycle of pusher arm assembly 204.

To accommodate the placing of the next side wall blank onto table 244 during the return cycle of pusher arm assembly 258, pusher arms 262 and pusher heads 264 are dropped below the surface of table 244 during the return cycle. In this regard, the bearing assemblies 268 are supported by lifter shafts 292 which are disposed generally perpendicular to pusher arms 262 in bearings 294. Shaft 292 is preferably attached to bearing assembly 268 by a bolt 296, threadably engaged with a center threaded bore 298 in the upper end of shaft 292.

Shaft 292 is reciprocated by cam assembly 300, as shown in FIGS. 30–33. The cam assembly generally includes a cam 302 which is driven off of drive shaft 68 and a rocker arm assembly 304. The rocker arm assembly includes a pivot shaft 306 having arms 308 and 310 mounted on each end of shaft 306. A cam follower 312 is affixed to cam arm 308 and a cam follower 314 affixed to arm 310. Pivot shaft 306 is pivotally mounted in a bearing 316 disposed in a portion of frame 12. The cam follower 314 abuts a contact surface 318 at the lower end of shaft 292.

Cam 302 is configured so that during the forward cycle of pusher arm assembly 258, cam follower 312 is moved radially outward by the cam 302, thus pivoting the rocker arms assembly 304, thereby lifting shaft 292 and pusher arms 262 into a position where alignment grooves 266 can be brought into registration with the edge of blank 38. During the return cycle of pusher arm assembly 304, cam 302 allows cam follower 312 to move radially inward. This in turn allows the rocker arm assembly 304 to pivot away from shaft 292. A return spring 320 on shaft 292 will cause shaft 292 and bearing assemblies 268 to move downward dropping the pusher rods to a position beneath the surface of vacuum table 244 so that a blank 38 can be placed on the table 244 during the return cycle of pusher arm assembly 262. Preferably, cam 302 is configured so that pusher arms 262 will move in the reverse direction far enough to disengage alignment grooves 266 from the edge of the blank before the pusher arms 262 drop below the table. By positioning pusher rod assembly 258 beneath the surface of table 244 during the return cycle, the efficiency of the side wall blank feeder station is greatly increased. The side wall blanks 38 can be positioned on table 244 and heated along their ends 38A and 38B by heater assemblies 254, 256, while pusher arms 262 return to their initial position, leaving no down time.

HEATER ASSEMBLY

Means are provided for heating the ends 38A and 38B of the side wall blanks 38 during the time the push rod assembly 258 is in the return cycle. Such means is in the form of an upper heater assembly 254 and the lower heater assembly 256 as shown in FIGS. 27, 28 and 29. Both heater assemblies generally include a heater tube 328 having number heaters 162 as described above. An air inlet valve 320 is provided on the end of each tube 328. The heater tube 328 is pivotally mounted on a bracket 330 below the vacuum plate assembly 244 by a pin 331. A pneumatic piston and cylinder assembly 332 is operatively connected to the bracket 330 by a pin 333 and to the other end of the heater tube 328 by a pin 335 for raising and lowering the heater tube 328.

The upper heater assembly 254, FIG. 27, includes a plate 334 at the end of the heater tube 328 which projects above the end 38A of the blank 38. An air passage 336 is provided in the plate 334 which terminates at a groove 338 in the face of the plate 334. A deflector plate 340 having a downwardly directed line of openings 342 is mounted on the face of the plate 334 over the groove 338. Air blown through the heater tube 328 is heated and passes through passage 336, groove 338 and downward through openings 342 against the top of the end 38A of the blank 38. The lower heater assembly, FIG. 29, also includes a plate 342 mounted on the end of heater tube 328 immediately below the end 38B of the blank 38. A passage 344 is provided throughout the length of the plate 342 with a series of openings 346 directed upwardly from the passage 344 toward the bottom of the end 38B of the blank 38. Air blown through the heater tube 328 is heated and passes through passage 344 and openings 346 upwardly against the end 38B.

FOLDING WING ASSEMBLY

Figure 34:
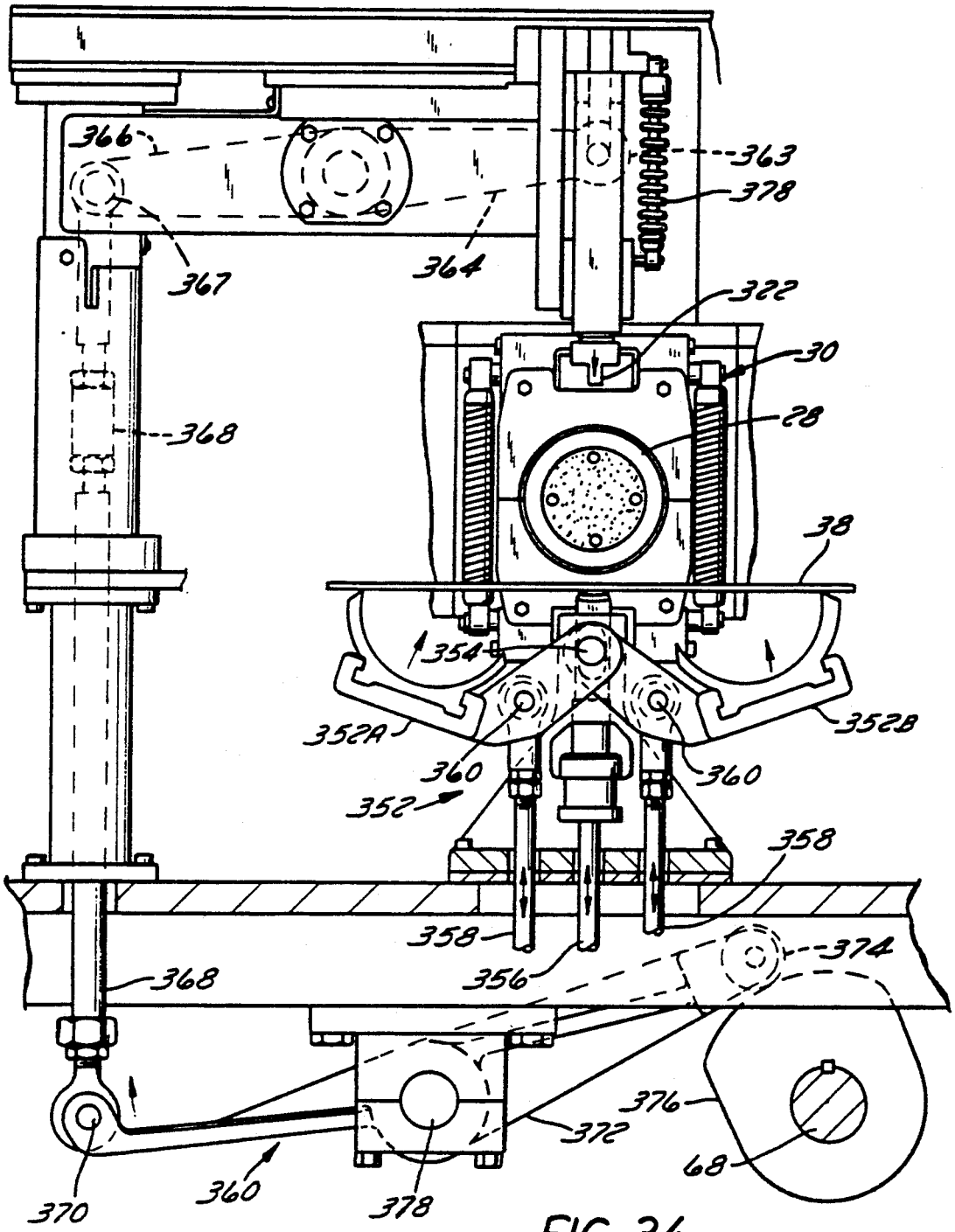
FIG. 34 is a front view of the mandrel with the folding wings in the open position.

After the ends 38A and 38B of the side wall blank have been heated, the side wall blank 38 is pushed onto a folding wing assembly 352 positioned under the mandrel 28. The folding wing assembly 352 includes a pair of folding wings 352A and 352B, FIGS. 34 and 35, which wrap the side wall blank 38 around the mandrel 28 so that the heated ends 38A and 38B, FIG. 29, are brought into contact with each other on the top of the mandrel 28. At this point, a seam clamp assembly 322 presses the overlapping ends together to insure a proper seal.

More particularly, the folding wings 352A and 352B are pivotally connected to a pin 354 which is aligned in a slot 355 in post 356 and to rods 358 by pins 360. A clamp 362 is positioned on the upper end of post 356 to initially seat the blank 38 on the mandrel. The rods 358 are moved upward to swing the wings 352A and 352B and side wall blank 38 around the periphery of the mandrel 28. The movement of wing 352A preceding the movement of wing 352B in order for the heated end 38B of blank 38 to overlap the heated end 38B.

Figure 35:
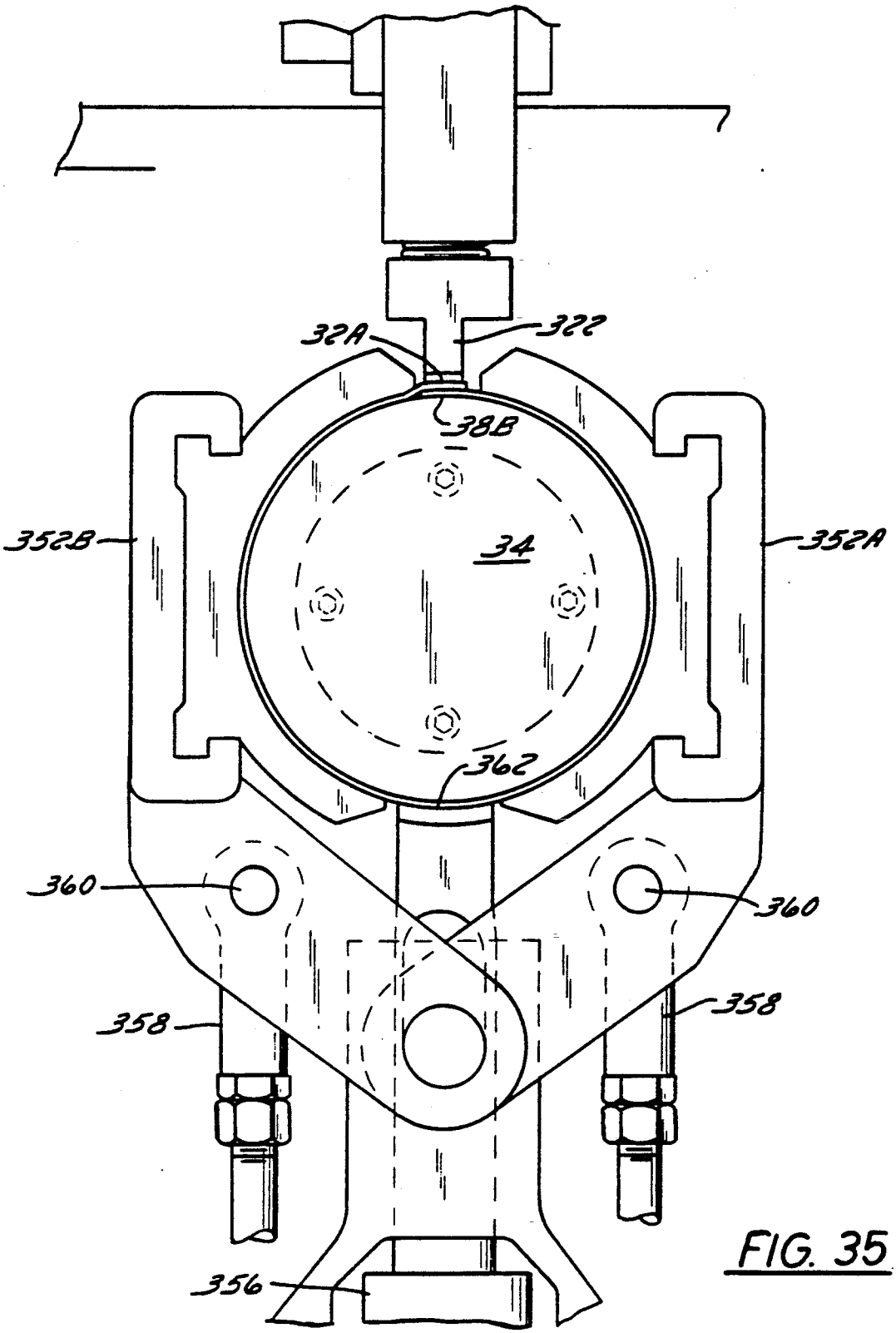
FIG. 35 is a view of the mandrel with the wings closed.

The lower end of post 356 is connected to a rocker arm 380 which is pivotally connected to the shaft 378. The other end of rocker arm 380 includes a cam follower 382 which is positioned to engage a cam 384 on drive shaft 68 (FIG. 12). The rocker arm 380 lifts the clamp 362 to move the center of the side wall blank 38 into engagement with the mandrel 28 (FIG. 35). At the same time the folded wings 352A and 352B are lifted by rocker arms 386 and 388 which are pivotally connected to the ends of rods 358. The rocker arm 386 is pivotally mounted on a shaft 385 and includes a cam follower 390 which is aligned with a cam groove 392 in cam plate 394 mounted on drive shaft 68. The rocker arm 388 is pivotally connected at one end to a shaft 389 and includes a cam follower 396 which is aligned with a cam groove 398 in cam plate 400 which is mounted on a shaft 400. The cam plate 400 rotates at the same speed as the cam plate 394 in order to synchronize the movements of the folding wings 352A and 352B and clamp 362. This is achieved by connecting the drive shaft 402 for cam plate 400 to the drive shaft 68. This is accomplished by mounting a drive sprocket 404 on drive shaft 68 and a corresponding drive sprocket 406 to shaft 402. The sprockets 404 and 406 are connected by a chain 408.

The overlapped ends 38A and 38B are sealed by means of a seam clamp 322 which is actuated by a linkage assembly 361. In this regard, the seam clamp 322 is lo mounted on one end 361 of a rocker arm 364. The other end 366 of the rocker arm 364 is connected to one end of a rod 368 by a pin 367. The other end of the rod 368 is connected to one end 370 of a rocker arm 372 which is pivotally connected to a shaft 378. A cam roller 374 is mounted on the other end of the rocker arm 372 in a position to engage the edge of a cam 376 mounted on drive shaft 68. It should be noted that seam clamp 322 is biased to an open position by a spring 378.

Thus, it should be apparent that there has been provided in accordance with the present invention a cup making machine that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A machine for making cups of thermoplastic coated paper, each cup including a side wall blank and a disc-like bottom wall blank, said machine comprising a frame, a turret rotatably mounted on said frame, a number of work stations mounted on said frame in an equally spaced relation around said turret, a number of mandrels corresponding to the number of work stations mounted on said turret, a curling die mounted on said turret in radial alignment with each of said mandrels, means for intermittently rotating said turret to move said mandrels sequentially into alignment with said work stations, and means mounted on said turret for moving said mandrels radially inwardly toward said curling die to curl the top edge of the side wall blank, said mandrel moving means comprising a cam plate mounted for rotation with respect to said turret, said cam plate including a cam groove, means mounted on said mandrels operatively engaging said cam groove and means for connecting said cam plate to said rotating means for rotating said cam plate with said turret when the mandrels are advanced to the next work station and for returning said cam plate to its initial position to move said mandrels radially inwardly and means for moving said work stations into engagement with said mandrels as the mandrels are moved inwardly by the cam plate.

2. A machine for making cups of thermoplastic coated paper, each cup being formed from a side wall blank and a disc-like bottom wall blank, said machine comprising a frame, a turret mounted on said frame for rotation with respect to the frame, a number of work stations mounted on said frame in a spaced relation around the perimeter of said turret, said work stations are sequentially arranged to place a bottom wall blank on the mandrel at the first work station, to wrap a side wall blank on the mandrel at the second work, station, to heat the bottom edge of the side wall blank at the third work station, to seal the heated edges of the side wall blank on the end cap at the fourth work station, to complete the seal at the base of the cup at the fifth work station, and to release the cup from said mandrel at the sixth work station, a mandrel mounted on said turret radially inwardly of each of said work stations, a curling die mounted on said turret radially inwardly of each of said mandrels, means for rotating said turret in a step-by-step manner to sequentially position said mandrels in alignment with said work stations, means for moving certain of said work stations toward said mandrels, and means mounted on said turret for progressively moving said mandrels radially inwardly toward said curling die to curl the top of the side wall blanks, wherein said means for moving said mandrels radially inwardly toward said curling die to seat the top edge of the side wall blank in the curling side at the third work station, to initially curl the top edge outwardly from the side wall blank at the fourth work station and to complete the curl of the top edge in the curling die at the fifth work station.

3. The mandrel according to claim 2 including means for feeding side wall blanks to a mandrel at the second work station.

4. The machine according to claim 3 wherein said side wall blank feeding means includes a magazine for supporting the side wall blanks, a plate positioned at the end of said magazine, means for removing a side wall blank from said magazine to said plate, means at one end of the plate for heating the top of the edge at one end of said side wall blank and means at the other end of the plate for heating the bottom of the edge at the other end of the side wall blank and means for pushing the side wall blank under the mandrel in synchronism to the movement of the mandrels to the next work stations.

5. The machine according to claim 4 wherein said pushing means comprises a pair of push rods having means on the ends of the rods for engaging the bottom edge of the side wall blank, means for moving said push rods to push the blank into alignment with a mandrel, said removing means placing another side wall blank on said plate as a blank is pushed off said plate and means for dropping said rods below said plate on the return motion of said rods to the pushing position whereby the ends of the side wall blanks are heated during the return motion of the rods.

6. The machine according to claim 2 including means at the end of each mandrel for reducing air noise, said means comprising a sintered metal plate on the outer end of each of said mandrels wherein air drawn through the sintered plate will hold the disc-like blank on the end of the mandrel and wherein air discharged through said sintered plate will blow the cup off of the mandrel.

7. A machine for making cups of thermoplastic coated paper, each cup including a side wall blank and a disc-like bottom wall blank, said machine comprising a frame, a turret rotatably mounted on said frame, a number of work stations mounted on said frame in an equally spaced relation around said turret, said work stations including a bottom disc placer station, a side wall blank folding station, a heat station, an incurl station, a rimming station, and a blow-off station, a number of mandrels mounted on said turret corresponding to the number of work stations, a curling die assembly mounted on said turret in radial alignment with each of said mandrels, means for intermittently rotating said turret to move said mandrels sequentially into alignment with each of said work stations, means on said frame for moving said heat station, incurl station and rimming stations toward said mandrels, means mounted on said turret for moving said mandrels radially inwardly toward said curling die assemblies at said heat, incurl and rimming stations, and means for blowing the cup off of the mandrel at the blow-off station.

8. The machine according to claim 7 wherein said mandrel moving means comprises a cam plate mounted for rotation with respect to said turret, said cam plate including a cam groove operatively engaging each of said mandrels and means operatively connecting said cam plate to said rotating means for rotating said cam plate with said turret when the mandrels are advanced to the next station and returning said cam plate to its initial position wherein the said mandrels at the heat, incurl and rimming stations are moved inwardly toward said curling die.

9. The machine according to claim 8 including means for placing a bottom wall blank on the end of a mandrel at the bottom placer station, means for aligning a side wall blank with a mandrel at the folding station, and means for wrapping the side wall blank around the mandrel at the folding station.

10. The machine according to claim 9 wherein said side wall blank placer station includes a magazine for holding a plurality of side wall blanks, a vacuum plate positioned intermediate said magazine and one of said mandrels, vacuum pick-up means for transporting a side wall blank from said magazine to said vacuum plate, and means for pushing the blank off of said vacuum plate to a position between said mandrel and wrapping means.

11. The machine according to claim 10 including means on each end of said vacuum plate for heating the side edges of said side wall blank on the return motion of said pusher means.

12. The machine according to claim 9 wherein said wrapping means includes a pair of folding wings and a clamp positioned and beneath said mandrel, means for moving said clamp into abutting relation to said mandrel to clamp the bottom wall blank to the mandrel, and means for folding the side wall blank around the mandrel with the side edges overlapped.

13. A machine for making cups of thermoplastic coated paper, each cup including a side wall blank and a disc-like bottom wall blank, said machine comprising a housing and a frame, a turret mounted on said frame for rotation with respect to the housing, a number of work stations mounted on the housing in an equally spaced relation around the perimeter of said turret, said work stations including a first work station for placing the bottom wall blank on the end of the mandrel, a second work station for wrapping a side wall blank on the mandrel, a third work station for heating the bottom edge of the side wall blank, a fourth work station for sealing the heated edge of the side wall blank on the bottom wall blank, a fifth work station for rimming the edge of the cup, and a sixth work station for blowing the cup off of the mandrel, a mandrel mounted on said turret radially inwardly of each of said work stations, means for rotating said turret in a step-by-step manner to sequentially position the mandrels in alignment with said work stations, a curling die assembly mounted on said turret radially inwardly of each of said mandrels, and means mounted on said turret for progressively moving said mandrels radially inwardly toward said curling die to form a curl at the top of the blank, said means for moving said mandrels radially inwardly toward the curling die at the third, fourth and fifth work stations comprises a cam plate having a cam groove aligned with said cam followers and an oscillating linkage assembly operatively connected to said rotating means for advancing the cam plate with the turret and returning the cam plate to tis original position whereby the cam groove will advance the mandrel at the third work station toward the curling die to align the top edge of the side wall blank with the curling die, advance the mandrel at the fourth work station toward the curling die to initially curl the top edge and advance the mandrel at the fifth work station toward the curling died to fully tuck the curl into the top edge of the blank.

14. The machine according to claim 13 wherein each of said mandrels includes a noise suppressor in the form of a sintered metal plate on the outer end of each of said mandrels wherein air drawn through the bottom of the plate will hold the disc-like blank on the end of the mandrel and wherein air discharged through said sintered plate will blow the cup off of the mandrel.

15. A machine for making cups of thermoplastic coated paper, each cup including a side wall blank and a disc-like bottom wall blank, said machine comprising a housing, a turret mounted on said frame for rotation with respect to the housing, a number of work stations mounted on the housing in an equally spaced relation around the perimeter of said turret, said work stations including a first work station for placing the bottom wall blank on the end of the mandrel, a second work station for wrapping a side wall blank on the mandrel, a third work station for heating the bottom edge of the side wall blank, a fourth work station for sealing the heated edge of the side wall blank on the bottom wall blank, a fifth work station for rimming the edge of the cup, and a sixth work station for blowing the cup off of the mandrel, a mandrel mounted on said turret radially inwardly of each of said work stations, means for rotating said turret in a step-by-step manner to sequentially position the mandrels in alignment with said work stations, a curling die assembly mounted on said turret radially inwardly of each of said mandrels, and means mounted on said turret for progressively moving said mandrels radially inwardly toward said curling die to form a curl at the top of the blank, including means for feeding the side wall blank to the mandrel at the second work station wherein said side wall blank feeding means includes a vacuum plate positioned at the second work station in alignment with the mandrel, means at one end of the plate for heating the top of one side edge of the side wall blank and means at the other end of the plate for heating the bottom of the other side edge o the side wall blank and means for pushing the side wall blank under the mandrel in synchronism with the movement of the next mandrel to the second work station and simultaneously placing a side wall blank on the vacuum plate.

16. The machine according to claim 15 wherein said pushing means comprises a pair of push rods having means on the ends of the rods for engaging the edge of the side wall blank, means for moving said rods to push the blank into alignment with a mandrel, and means for dropping said push rods below said plate to allow for the placement of the next side wall blank on the vacuum plate during the return motion of said rods to the pushing position.

* * * * *